United States Patent [19]

Teyssier, Jr.

[11] Patent Number: 4,494,948

[45] Date of Patent: Jan. 22, 1985

[54] AIR CONTROLLED PAPER STACKER

[75] Inventor: Emil G. Teyssier, Jr., Lansdale, Pa.

[73] Assignee: Sperry Corporation, New York, N.Y.

[21] Appl. No.: 395,209

[22] Filed: Jul. 6, 1982

[51] Int. Cl.[3] ..... B31F 7/00

[52] U.S. Cl. ..... 493/11; 493/23; 493/410; 493/412; 493/418; 226/97

[58] Field of Search ..... 19/299; 28/282, 283, 28/288, 289; 493/10, 11, 23, 410, 412, 413, 414, 415, 418, 430, 433, 450; 226/97; 270/39

[56] References Cited

U.S. PATENT DOCUMENTS

| | | | |
|---|---|---|---|
| 2,016,539 | 10/1935 | Brenn | 270/79 |
| 3,305,247 | 2/1967 | Fulk | 282/11.5 |
| 3,658,364 | 5/1972 | Da Mert | 281/5 |
| 3,735,975 | 5/1973 | Sukel et al. | 493/418 X |
| 3,953,019 | 4/1976 | Burke | 270/61 F |
| 3,961,781 | 6/1976 | Funk | 493/23 X |
| 3,999,656 | 12/1976 | Reba et al. | 226/97 X |
| 4,019,947 | 4/1977 | Stock et al. | 493/209 X |
| 4,054,283 | 10/1977 | Rayfield | 493/412 X |
| 4,194,685 | 3/1980 | Hill et al. | 235/375 |
| 4,285,452 | 8/1981 | Reba et al. | 226/97 X |
| 4,358,285 | 11/1982 | Fujino | 493/415 X |

FOREIGN PATENT DOCUMENTS

| | | | |
|---|---|---|---|
| 1214983 | 4/1966 | Fed. Rep. of Germany | 270/61 F |
| 2316686 | 4/1973 | Fed. Rep. of Germany | 493/412 |

OTHER PUBLICATIONS

U.S. application No. 183,599, filed Sep. 2, 1980, Mittal et al.

*Primary Examiner*—Robert L. Spruill
*Assistant Examiner*—Steven P. Weihrouch
*Attorney, Agent, or Firm*—James R. Bell; Thomas J. Scott; Marshall M. Truex

[57] ABSTRACT

Apparatus is disclosed for stacking a continuous paper form having uniformly positioned folds or seams as it exits from a device such as a printer. It utilizes a pair of curved surfaces over which an air flow is alternately directed to alternately create an air film over each of the curved surfaces. This air film attracts the paper in such a manner that the continuous paper form is refolded in a bin or stacker in its original configuration.

5 Claims, 14 Drawing Figures

AIR CONTROLLED PAPER STACKER

BACKGROUND OF THE INVENTION

1. Field of the Invention

The present invention relates to paper stackers, more particularly it relates to continuous forms paper stackers which are used in conjunction with printers.

2. Description of the Prior Art

Generally, prior art stackers were used for folding a free-falling, continuous stream of paper. One known prior art stacker used with high speed computer printers utilized spinning beaters or flappers. A movable tray was provided to maintain an optimum distance between the top of a paper stack and pair of feeder rollers. The spinning beaters were placed on a rotating axle and comprise deformable plastic extensions that extend from a hub permanently positioned on the rotating axle. The flappers were located on the tray on which the continuous paper form was received after printing, such that they were in juxtaposition to the crease as they were about to fold. In effect, the flappers beat on the seams of the refolded stack and thereby aid in maintaining a substantially flat stack.

A shortcoming of this prior art is that, due to its reliance on free-falling action of the paper it has limitations handling the wide variety of paper forms which are used. Thus, when stacking is not performed properly, the stacker must be stopped and the operator must provide manual assistance.

Another difficulty with prior art techniques occurred in the case of high speed laser printers. In these printers, heat and pressure are used in the process of fusing the toner to the paper. The heat and pressure cause the creases or seams of the continuous form to be ironed-out so that re-stacking is even more difficult.

Previous attempts to overcome these problems in the higher speed printers have been either overly complex or unsatisfactory.

The foregoing illustrates limitations of known prior art. Thus, it is apparent that it would be advantageous to provide an alternative directed to overcoming one or more of the limitations as set forth above. Accordingly, a suitable alternative is to provide an air controlled paper stacker including features more fully disclosed hereinafter.

SUMMARY OF THE INVENTION

In one aspect of the invention this is accomplished by providing a paper stacker for the refolding of a substantially continuous unfolded paper form including a first and a second forced air supply, a first and second curved surface closely positioned to one another in a facing relationship, means for controlling forced air including an input and an output, the input coupled to movement of the paper form to receive information therefrom, and the output coupled to the first and second forced air supplies.

The foregoing and other aspects will become apparent from the following detailed description of the invention when considered in conjunction with the accompanying drawings. It is to be expressly understood, however, that the drawings are not intended as a definition of the invention but are for the purpose of illustration only.

DETAILED DESCRIPTION OF THE PREFERRED EMBODIMENT

Figure 1:
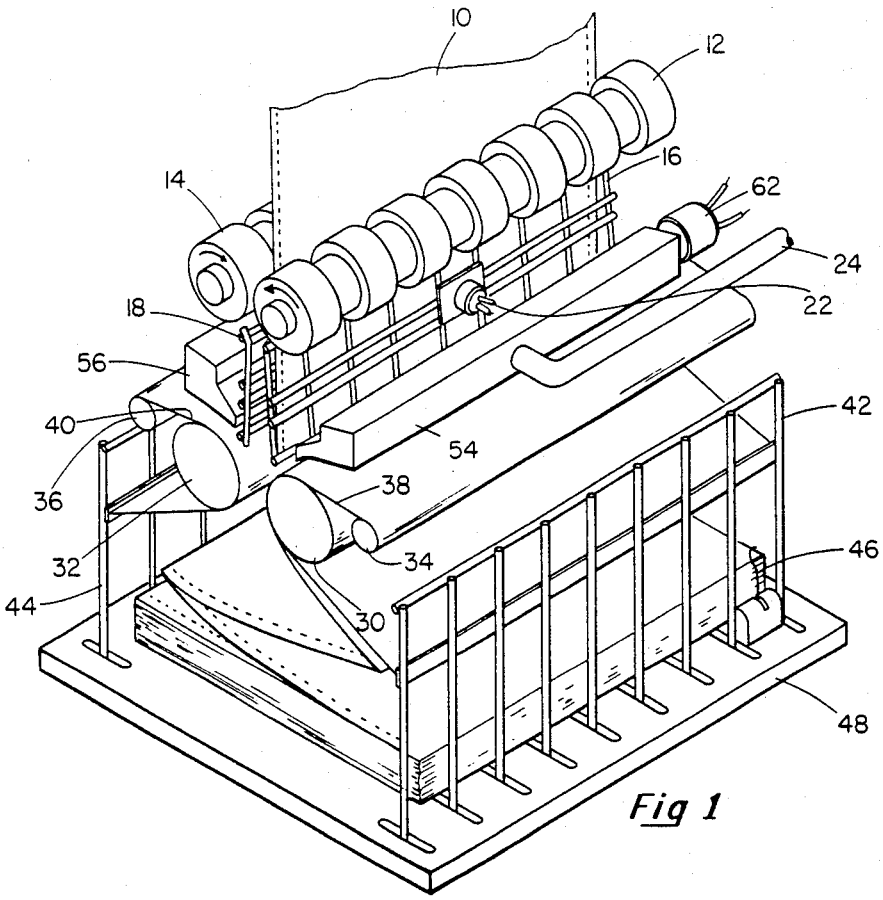
FIG. 1 illustrates a pictorial isometric view of an embodiment of the air-controlled paper stacker.
Figure 2:
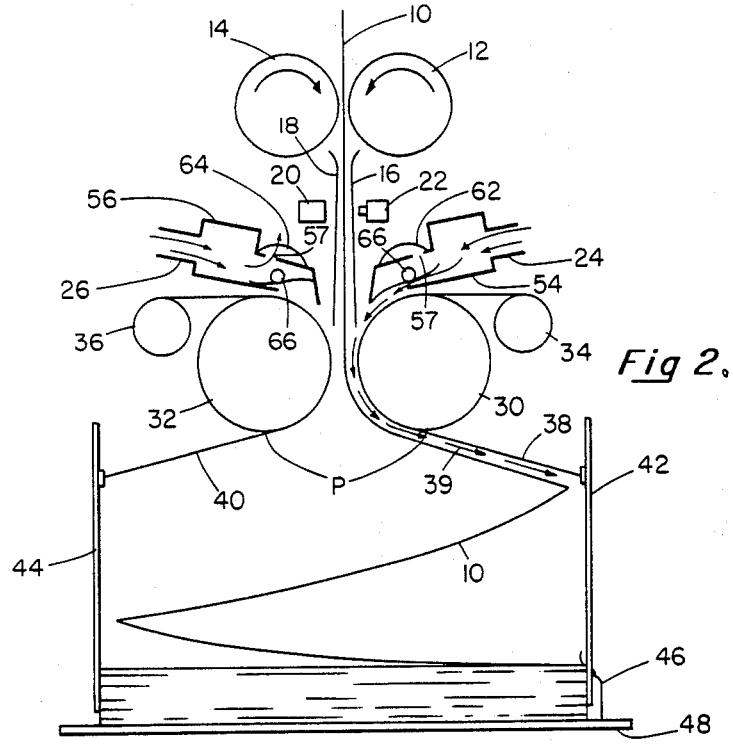
FIG. 2 is an enlarged cross-sectional view of an embodiment of the air controls and the curved surfaces of the stacker.

FIGS. 1 and 2 illustrate generally the entire paper stacker. The paper 10 is received between a first 12 and a second 14 plurality of stacker rollers. It is thereafter directed between a pair of diverging paper guides 16 and 18. By diverging is meant that, a space between the guides 16, 18 is not the same at one end as at an opposite end. The paper 10 then passes a photo-optic sensor 20 and a photo-optic light 22 which indicates to the control mechanism that paper is in the stacker. A pair of air supply tubes 24 and 26 direct an air supply to a pair of air control valves 54, 56 located on opposite sides of the paper 10.

A pair of sheet supply rollers; which are called herein window shade rollers 34, 36 provide a first and second plastic sheet 38, 40 which is pulled around a first and second hollow cylinder 30, 32 and attached to a pair of adjustable fences 42, 44. As the paper 10 passes elongated air control valves 54, 56, a film of air emanates either from valve 54 or 56. The valves are operated by a pair of rotary solenoids 62, 64 which are connected to valves 54, 56 by rods 66. Solenoid 64 is behind the paper 10 and is therefore not shown in FIG. 1, however it is identical to solenoid 62. A stack height sensor 46 is coupled to adjust platform 48 to a desired level for maintaining an optimum distance between the top of the stack of folded paper 10 and the lower extremities of the cylinders 30, 32 at point P.

A more detailed illustration of this stacker is shown cross-sectionally in FIG. 2. The paper 10 is again shown passing between stacker rollers 12, 14 down through paper guides 16, 18 past between the photocell light 22 and sensor 20 along the curved surface of the hollow cylinder 30 which is covered by the poly plastic sheet 38. It should be noted here that the rollers 34, 36 operate in the identical fashion to window shades (and are so-called) because they supply the poly plastic sheets 38, 40 which are adjustable in accordance with the position of the adjustable fences 42, 44.

In the position shown in FIGS. 1 and 2 the air is supplied by valve 54, and is directed around the curved surface of hollow cylinder 30. At this time, the air supply valve 56 is positioned to exhaust the air out of a discharge ort 57 as indicated by directional arrows.

As air is directed onto the curved surface of cylinder 30 (covered by plastic sheet 38) an air film or stream becomes attached thereto (Coanda effect). The resultant air film 39 passing over that surface follows the contour of the curve and because of the negative pressure (Bernoulli effect) on the outer edge of the air film, the paper 10 is attracted to the air film and it also follows the curved surface. Thus, the paper is forced to refold in the proper direction in accordance with the original perforated fold point of the paper forms.

There are two curved surfaces 30, 32 opposite each other, and the air is directed to one of these surfaces at a time, so the paper 10 is forced to refold in the proper direction.

Figure 3:
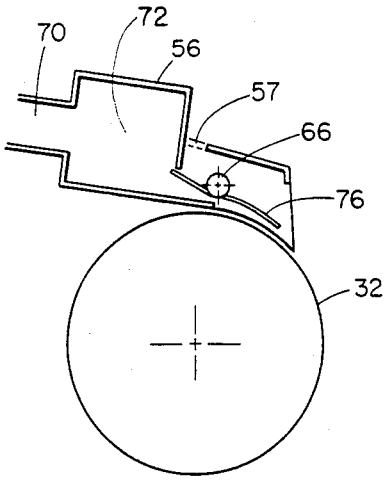
FIG. 3 is a pictorial view of an embodiment of the air flow mechanism showing the air flow being directed toward a curved surface.
Figure 4:
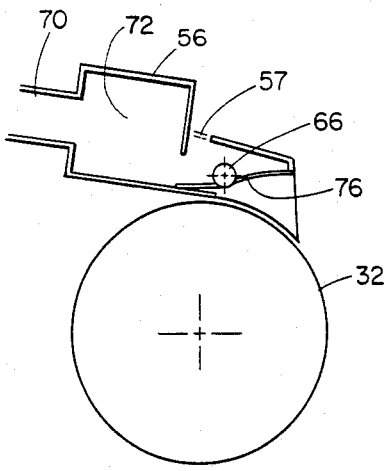
FIG. 4 is again a pictorial view of an embodiment of the air flow mechanism, however showing the air flow being exhausted through redirection.

FIGS. 3 and 4 pictorially illustrates the air flow control as it passes through one of the air control valves 54, 56.

In FIG. 3, the air flow is shown being directed onto the curved surface of cylinder 32. The air from tubing 26 enters the inlet 70 passes into manifold 72 and is directed by air direction guide 76 (which is controlled by rod 66) onto the cylinder 32 surface.

FIG. 4 shows the opposite situation. Here, air from tubing 26 enters inlet 70 passes through manifold 72 but is blocked by air direction guide 76 from passing onto the cylinder 32. In this case, the air is exhausted through top air discharge outlet 57.

The air film is directed onto the cylinder surface or blocked in accordance with control signals which electrically operate the pneumatic valves 54, 56. The timing for these valves is controlled by the electronic circuitry as shown in block diagram form in FIG. 5.

This invention is more fully understood when referring to the code edit appearing in the appendix and in conjunction with the flow diagrams of FIGS. 6–14. Line numbers of the code edit are coordinated with the flow diagrams where appropriate.

Figure 5:
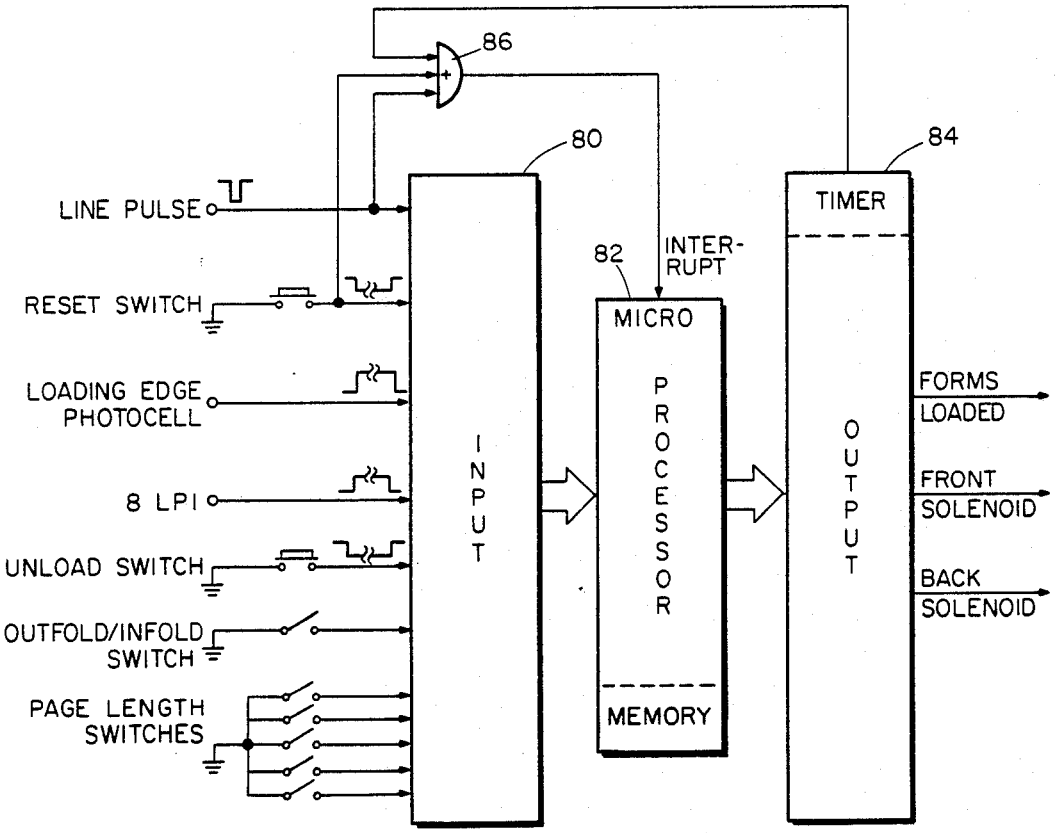
FIG. 5 is a block diagram of control circuit used herein.
Figure 6:
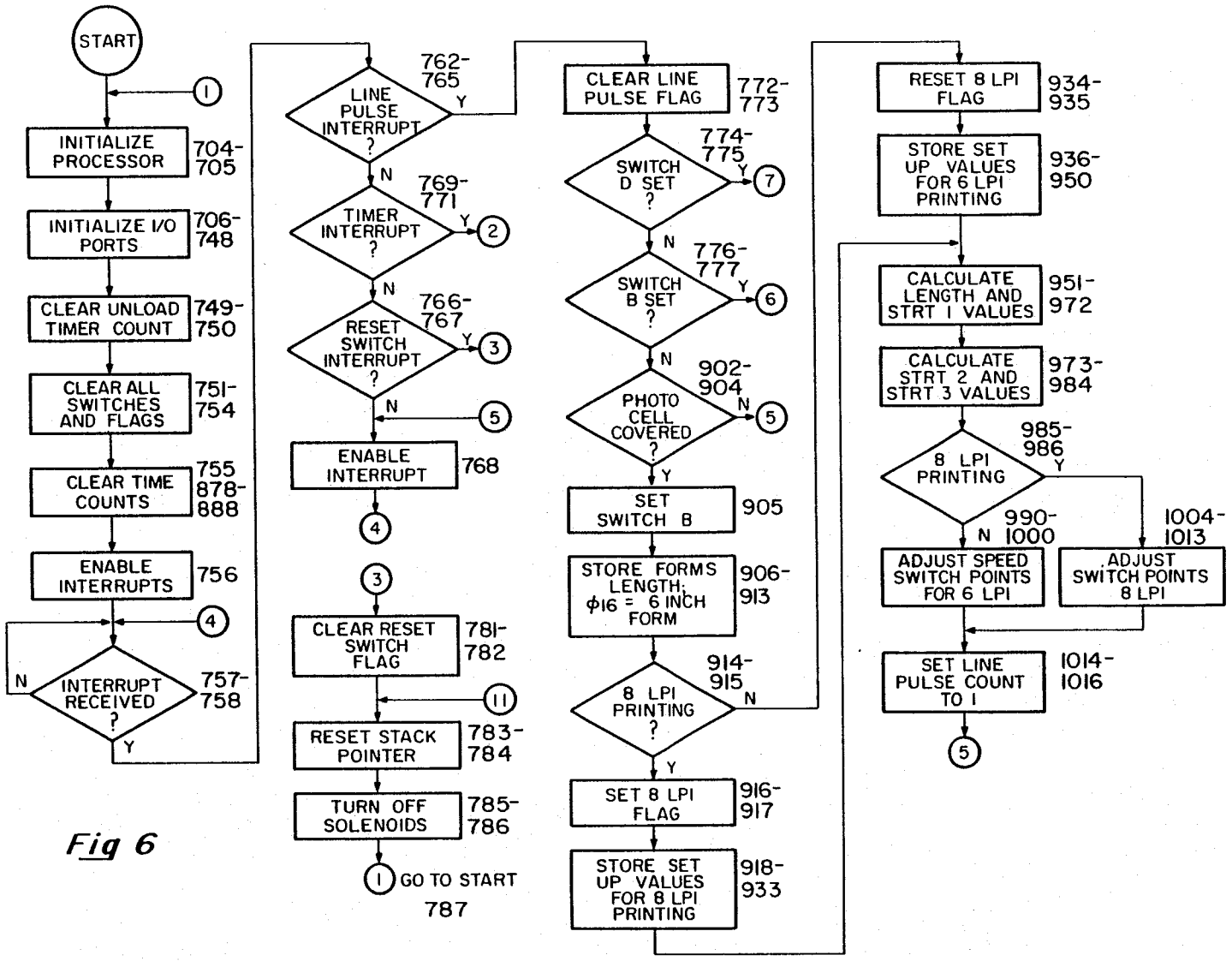
FIG. 6–14 comprise the flow chart of control system utilized by the circuit of FIG. 5 to operate the mechanism of FIG. 1.
Figure 7:
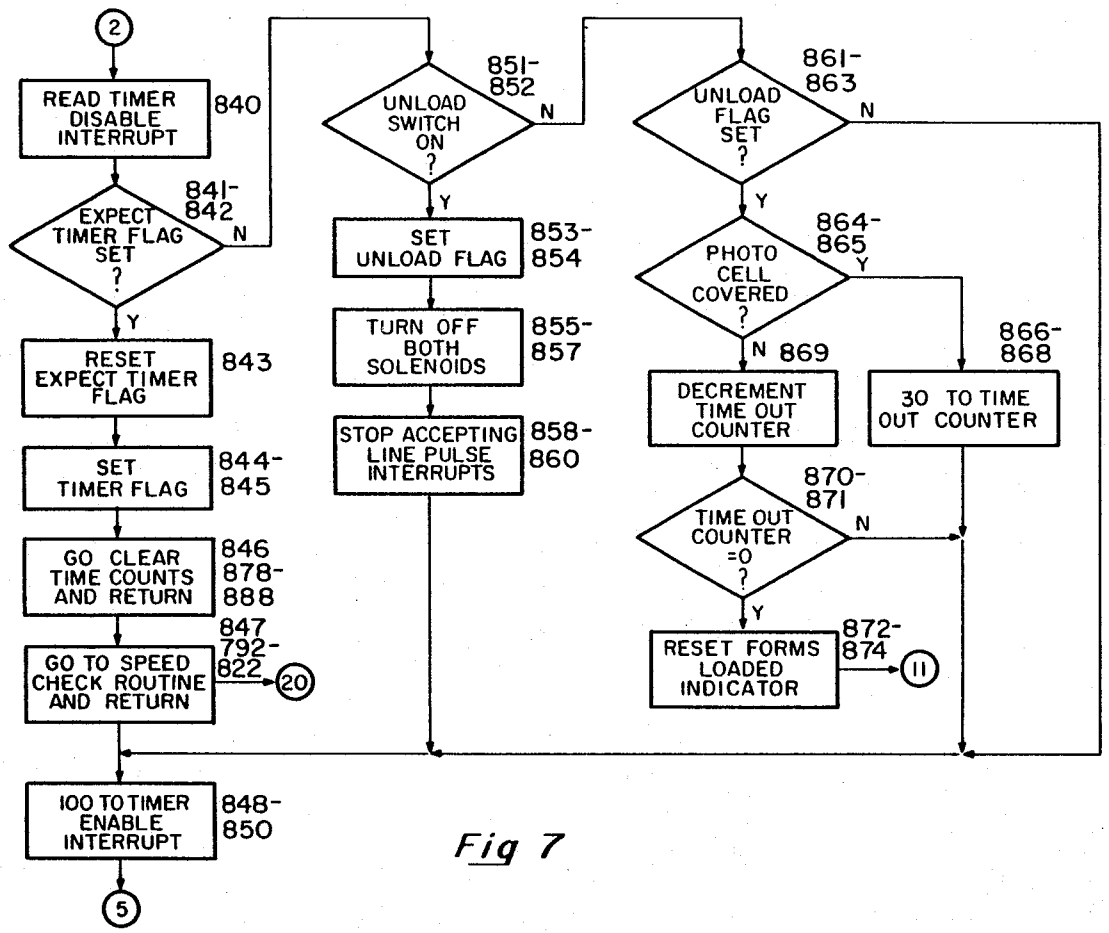
Figure 8:
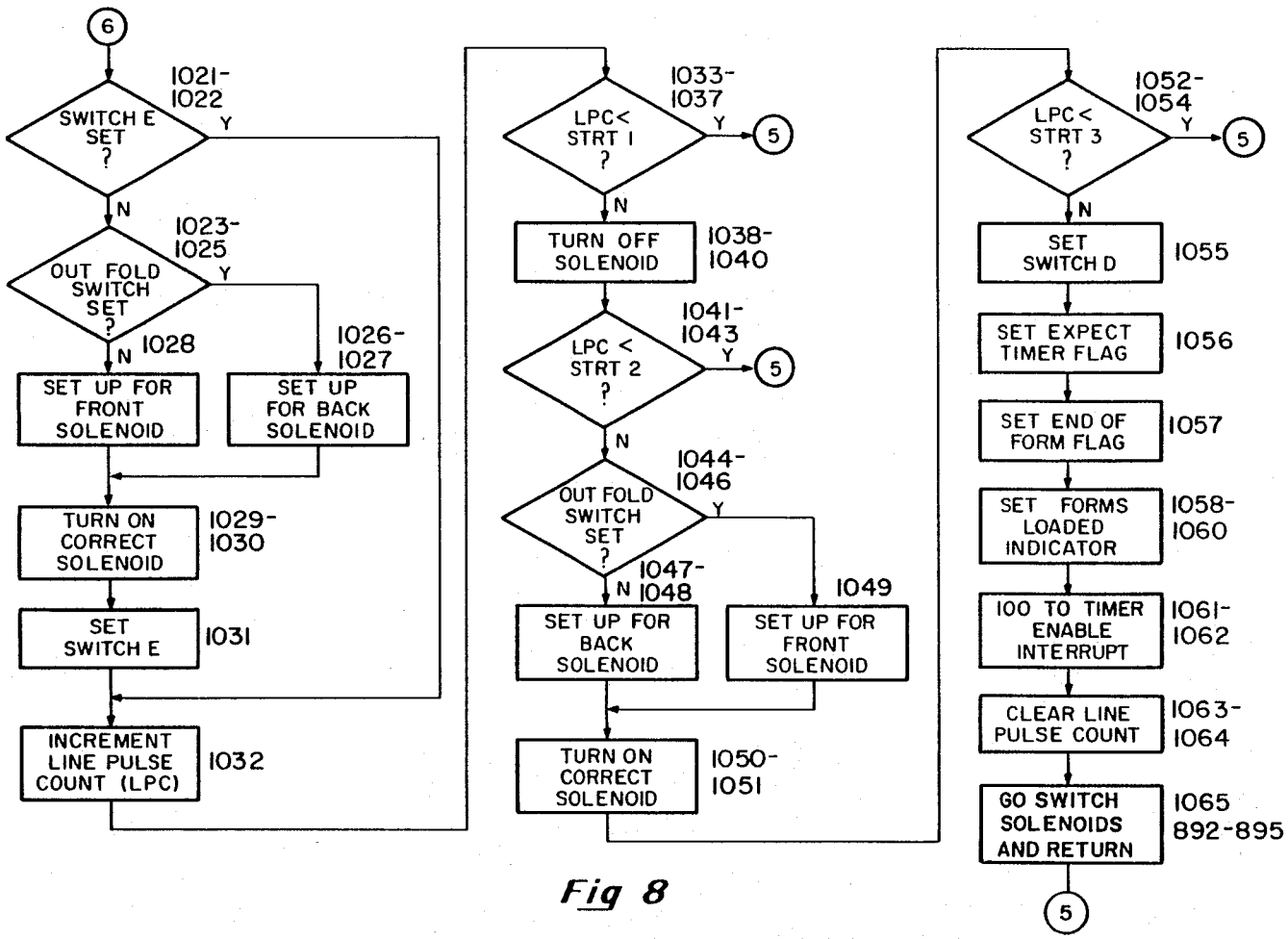
Figure 9:
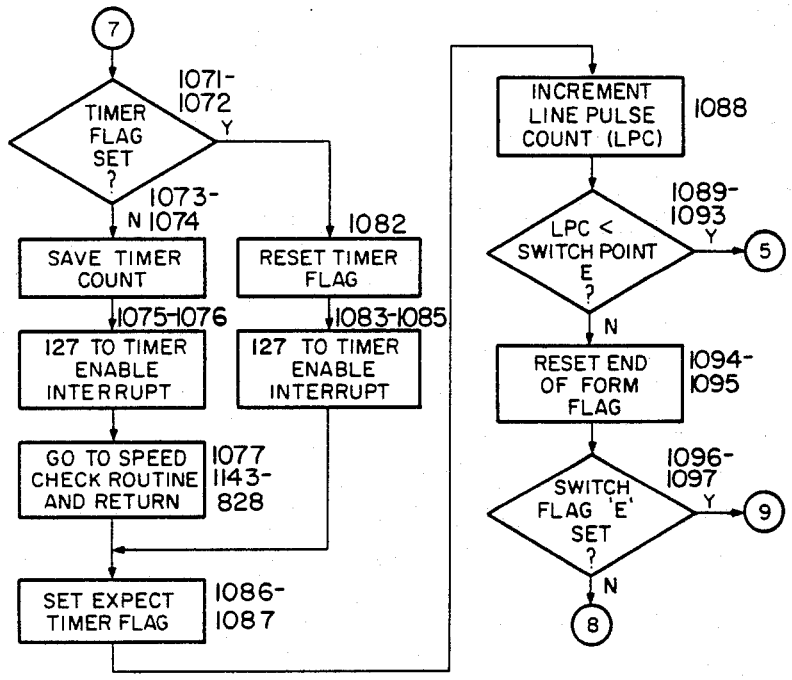
Figure 10:
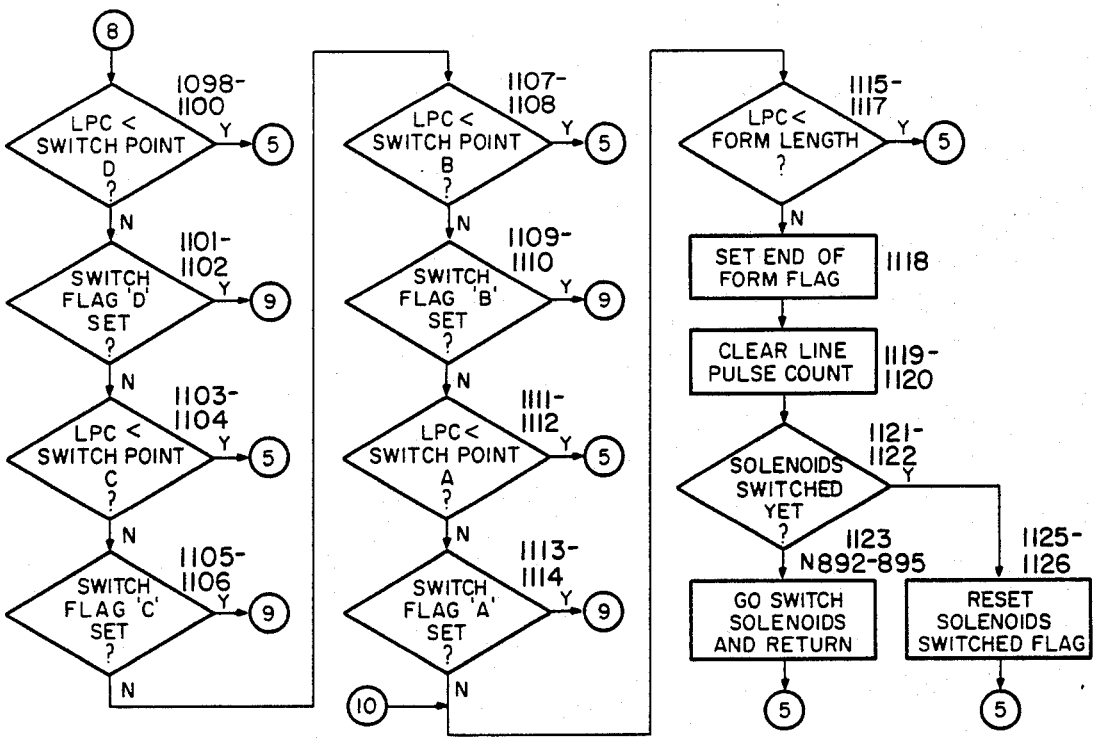
Figure 11:
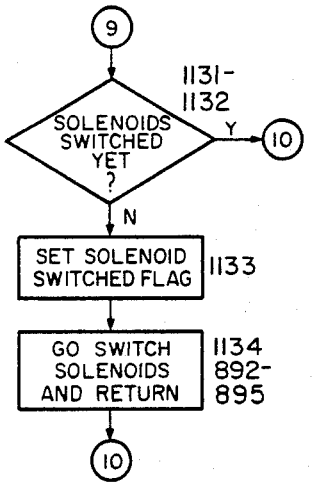
Figure 12:
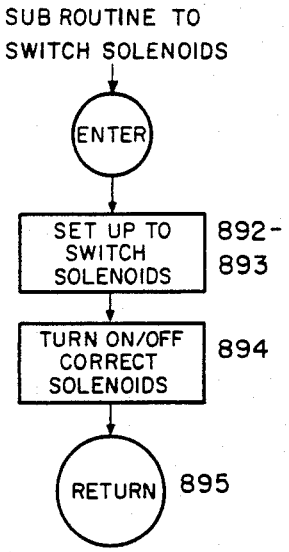
Figure 13:
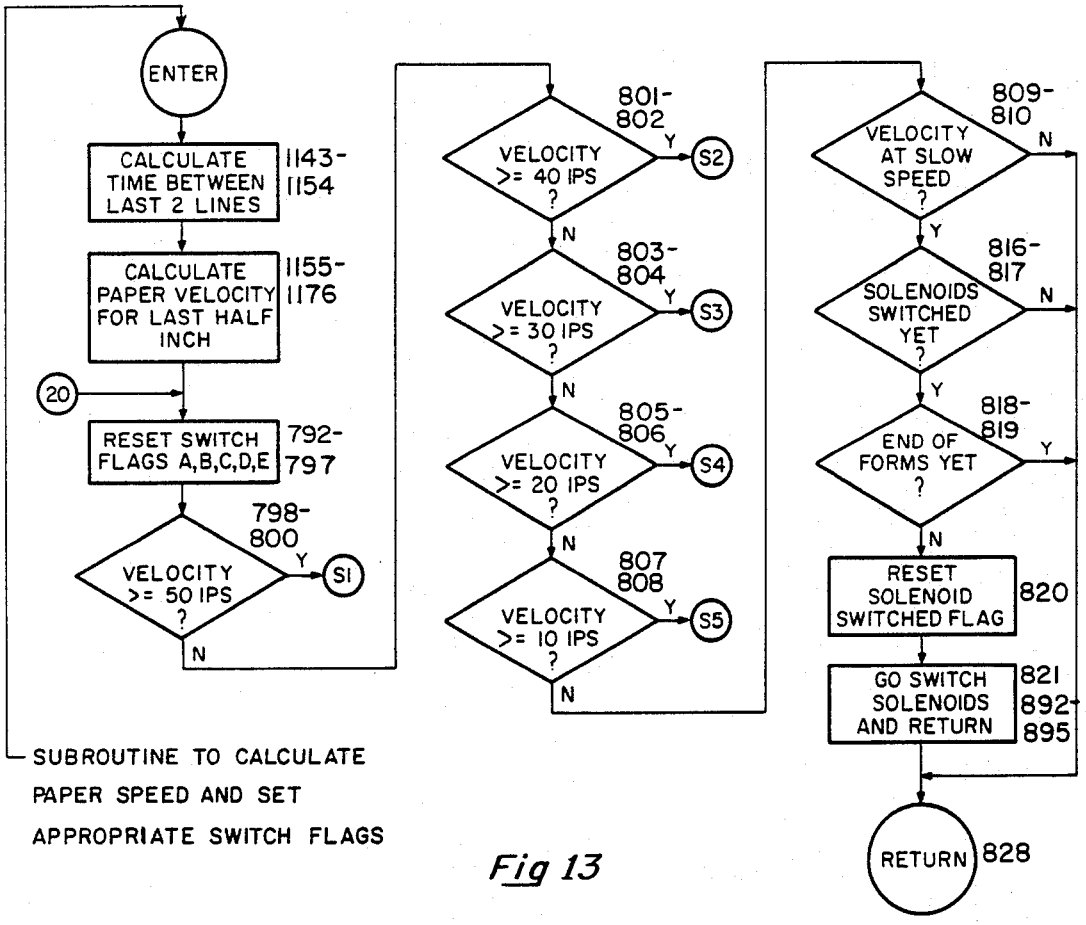
Figure 13:
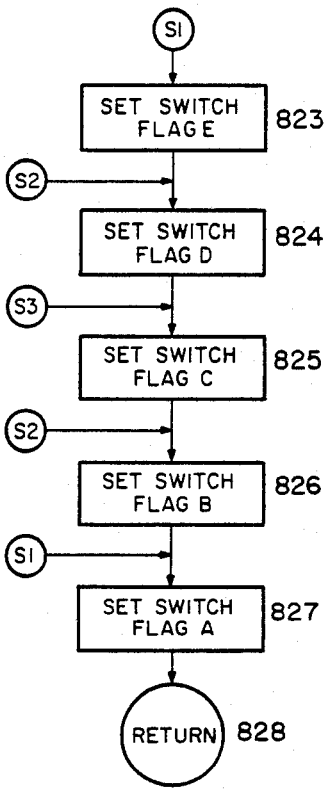
Figure 14:
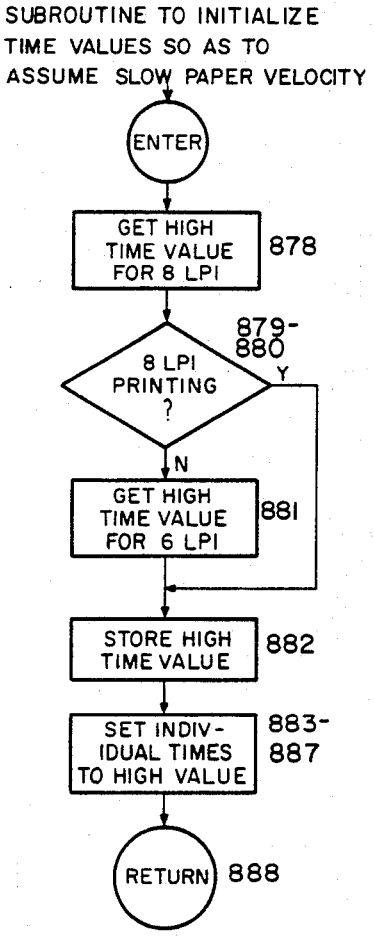

The circuitry of FIG. 5 is essentially that of a microprocessor 82 driven controller, the function of which is to operate on input signals so as generate output signals from output means 84 to switch the solenoids 62 and 64 at the proper time. Two of the input signals, namely the line pulse and 8LPI (lines per inch) are derived from an attached printer. The line pulse signal occurs with every increment of paper movement and the 8 LPI signal indicates whether printing is at 8 or 6 lines per inch. The remaining signals to the input means 80 are derived from additional components of the stacker mechanism.

After completion of an initialization process, interrupts are enabled and the program then operates in an interrupt driven mode. That is, the program is in an idle loop waiting for an occurrence of any one of the three signals; line pulse from the printer, internal timer completion, or reset switch signal. These signals are directed to the micro processor 82 through OR gate 86.

The normal conditions for starting operation is with the forms not yet between the power driven rollers. It is the operator's responsibility to set the outfold/infold switch in the proper position to indicate the direction of the first fold and to feed the forms into the power driven rollers. This first feeding of forms is performed at a slow stepping rate. This slow stepping rate will be maintained until the first two forms have passed under the curved surfaces of cylinders 30, 32. As the leading edge of the forms passes sensor 20 the leading edge photocell signal is developed. Up until this time, the interrupts generated by the line pulse signals have essentially been ignored. Once the leading edge photocell signal has been generated the next line pulse signal causes the program to examine the condition of the page length switches and the 8 LPI (lines per inch) signal. Appropriate counts, which will be used to control the switching of the air depending on the length of the form and the velocity of paper movement, are then stored in the program. Also at this time, the outfold/infold switch is examined and either the front solenoid signal or back solenoid signal is generated so as to energize the correct solenoid 62 or 64 in order to direct the first form in the proper direction. After this, a special sequence of switching the air off and on is used until the first two forms are loaded. This is to insure that the first page of the forms does not get mispositioned when the air is switched from one curved surface to the other. Upon completion of loading the first two forms, the forms loaded output signal is sent to an indicator (not shown) to indicate that forms have been loaded. After the first two forms have been loaded air will continuously be directed to either the front or back curved surface and switching will take place, back and forth, as the end of each page is detected by the program.

Also, after the first two forms are loaded, each line pulse received will cause an internal timer 84 (part of the output circuitry) to be triggered. Timer 84 will be set to count off a time interval greater than the normal time between lines when the associated printer is printing at it's normal rate. For example, if a printer normally prints at 1200 LPM, the time between line pulses will be 50 milliseconds and timer 84 will be set to some convenient time interval above 50 milliseconds. In the present program this time interval is set for 127 milliseconds. Thus, if the printer is printing at full speed, timer 84 will never expire and will be reset on the occurrence of each line pulse. Prior to being reset, however, the time remaining in the counter can be obtained, and from this value, the actual velocity of paper movement can be calculated. This has little consequence during normal printing, however, since the paper through-put rate of the above mentioned hypothetical 1200 LPM printer is roughly three inches per second when printing at six lines per inch. This rate is considered to be slow and switching takes place at the normal end of a page. But this hypothetical printer is also capable of slewing paper at a maximum rate of 50 inches per second. So the actual velocity can be in the range of 3 to 50 inches per second depending on the duty cycle of printing and slewing. For each line pulse received, the program calculates the average velocity of the forms for the preceeding one-half inch of movement, and causes solenoids 62, 64 to switch early if the velocity is above a certain value and a particular position of the form has been reached. Speeds of 10, 20, 30, 40 and 50 inches per second have been chosen as the velocities that will cause switching to occur early. Switching of solenoids 62, 64 is performed sooner, by a factor equal to one-half inch of form movement, for each of the five velocities.

When printing stops and there are no more line pulses being received, timer 84 will expire and an interrupt will be generated from the timer. This timer interrupt will then cause the velocity calculating subroutine to revert to a condition of slow speed. Also, if the end of this page has not yet been reached and solenoids 62, 64 have already been switched (because of prior high velocity forms movement), the solenoids will be switched back again. This is to insure that the air will be directed to the proper curved surface before starting form movement again.

After completion of a printing operation, the operator presses the unload switch which causes both solenoids 62, 64 to turn off so that the paper can fall freely into the stacker. Also, at this time, interrupts from the line pulse signals are inhibited. Then, three seconds after the trailing edge of the forms have passed the photoelectric sensor, the forms loaded signal is removed and the program returns to the starting point. After performing the initialization process the program is again ready for the start of a new printing operation.

Pressing the reset switch at any time causes the program to return to the initialization process.

The foregoing has described an air controlled, paper stacker which can provide accurate stacking of paper forms as they exit from a printer. Controlled air pressure is used to control the stacking of the paper forms, and the forms are forced to fold at the desired location and then settle in the desired orientation. This is decidedly advantageous when compared to known forms stackers which do not utilize forced folding but function only by the free-falling action of the forms.

It is anticipated that aspects of the present invention, other than those specifically defined in the appended claims, can be obtained from the foregoing description and the drawings.

```
ASSEMBLY OF POPSREVD     SYMBOLIC PROGRAM ON TRACK 01

STANDALONE Z-80 ASSEMBLER AND CROSS REFERENCER  REV-E

     PRINTED ASSEMBLY CODES:

     D DOUBLY DEFINED LABEL OR REFERENCE TO DOUBLY DEFINED LABEL
     E EXPRESSION ERROR OR IMPROPER SYNTAX
     I INSTRUCTION ERROR
     L LOCATION COUNTER TOO LARGE
     O ORIGIN ERROR OR SECOND DEFINITION OF A LABEL
     T TRUNCATION OF OVERSIZE TERM
     U UNDEFINED LABEL
     W WARNING, LABEL GREATER THAN 5 CHARACTERS
```

```
1                                   ;
2                                   ;  **    PCPS (PNEUMATICALLY OPERATED PAPER STACKER) CONTROL ROUTINE
3                                   ;        USING THE 'KIM' MICROCOMPUTER EQUIPPED WITH A 6502 MICROPROCESSOR
4                                   ;        AND A 'MEMORY PLUS' (MEM +) BOARD CONTAINING A 6522 VERSATILE
5                                   ;        INTERFACE ADAPTER CHIP.
6                                   ;
7                                   ;
8                                   ;  ***   THIS PROGRAM WAS ASSEMBLED ON A UNIVAC BC/7 COMPUTER USING THE
9                                   ;        BC/7 STAND ALONE ASSEMBLER.  EXTENDED MNEMONICS FOR THE 6502
10                                  ;        MICROPROCESSOR ARE USED IN THE FORM OF 'MACRO ELEMENTS'
11                                  ;        AS PER THE FOLLOWING LIST IN LINES 18 THROUGH 592.  THE MAIN
12                                  ;        BODY OF THE PROGRAM STARTS AT LINE 593.
13                                  ;
14                                  ;
15                                  ;  ***   PROGRAM ASSEMBLY REV. D.    OCTOBER 26, 1980
16                                  ;
17                                  ;
18                                  ;  **    EXTENDED MNEMONICS FOR THE 6502 MICPOPROCESSOR.
19                                  ;
20                                  ;
21                                  ;        ADD WITH CARRY MACROS
22                                  ;
23                                  ADCIM    MACRO P1;
24                                                                  DB     69H,P1;
25                                                                  ENDM;
26                                  ADCZ     MACRO P1;
27                                                                  DB     65H,P1;
28                                                                  ENDM;
29                                  ADCZX    MACRO P1;
30                                                                  DB     75H,P1;
31                                                                  ENDM;
32                                  ADCM     MACRO P1;
33                                                                  DB     6DH;
34                                                                  DW     P1;
35                                                                  ENDM;
36                                  ADCMX    MACRO P1;
37                                                                  DB     7DH;
38                                                                  DW     P1;
39                                                                  ENDM;
40                                  ADCMY    MACRO P1;
41                                                                  DB     79H;
42                                                                  DW     P1;
43                                                                  ENDM;
44                                  ADCIX    MACRO P1;
45                                                                  DB     61H,P1;
46                                                                  ENDM;
47                                  ADCIY    MACRO P1;
48                                                                  DB     71H,P1;
49                                                                  ENDM;
50                                  ;
51                                  ;        AND MACROS
52                                  ;
53                                  ANDIM    MACRO P1;
54                                                                  DB     29H,P1;
```

```
ANDZ      MACRO P1;
                                        ENDM;
                                        DB      25H,P1;
                                        ENDM;
ANDZX     MACRO P1;
                                        DB      35H,P1;
                                        ENDM;
ANDM      MACRO P1;
                                        DB      2DH;
                                        DW      P1;
                                        ENDM;
ANDMX     MACRO P1;
                                        DB      3DH;
                                        DW      P1;
                                        ENDM;
ANDMY     MACRO P1;
                                        DB      39H;
                                        DW      P1;
                                        ENDM;
ANDIX     MACRO P1;
                                        DB      21H,P1;
                                        ENDM;
ANDIY     MACRO P1;
                                        DB      31H,P1;
                                        ENDM;
;
;         ARITHMETIC SHIFT LEFT MACROS
;
ASLA      MACRO;
                                        DB      0AH;
                                        ENDM;
ASLZ      MACRO P1;
                                        DB      06H,P1;
                                        ENDM;
ASLZX     MACRO P1;
                                        DB      16H,P1;
                                        ENDM;
ASLM      MACRO P1;
                                        DB      0EH;
                                        DW      P1;
                                        ENDM;
ASLMX     MACRO P1;
                                        DB      1EH;
                                        DW      P1;
                                        ENDM;
;
;         BRANCH MACROS
;
BCC       MACRO P1;
                                        DB      90H,P1-$-2;
                                        ENDM;
BCS       MACRO P1;
                                        DB      0B0H,P1-$-2;
                                        ENDM;
```

```
BEQ     MACRO P1;
                                        DB      0F0H,P1-$-2;
                                        ENDM;
BMI     MACRO P1;
                                        DB      30H,P1-$-2;
                                        ENDM;
BNE     MACRO P1;
                                        DB      0D0H,P1-$-2;
                                        ENDM;
BPL     MACRO P1;
                                        DB      10H,P1-$-2;
                                        ENDM;
BVC     MACRO P1;
                                        DB      50H,P1-$-2;
                                        ENDM;
BVS     MACRO P1;
                                        DB      70H,P1-$-2;
                                        ENDM;
;
;       BIT MACROS
;
BITZ    MACRO P1;
                                        DB      24H,P1;
                                        ENDM;
BITM    MACRO P1;
                                        DB      2CH;
                                        DW      P1;
                                        ENDM;
;
;       BREAK MACROS
;
BRK     MACRO;
                                        DB      0CH;
                                        ENDM;
;
;       CLEAR STATUS AND CONTROL BIT MACROS
;
CLC     MACRO;
                                        DB      18H;
                                        ENDM;
CLD     MACRO;
                                        DB      0D8H;
                                        ENDM;
CLI     MACRO;
                                        DB      58H;
                                        ENDM;
CLV     MACRO;
                                        DB      0B8H;
                                        ENDM;
;
;       COMPARE MACROS
;
CMPIM   MACRO P1;
                                        DB      0C9H,P1;
```

```
CMPZ      MACRO P1;
                                          ENDM;
                                          DB      0C5H,P1;
CMPZX     MACRO P1;                       ENDM;
                                          DB      0C5H,P1;
CMPM      MACRO P1;                       ENDM;
                                          DB      0CDH;
                                          DW      P1;
CMPMX     MACRO P1;                       ENDM;
                                          DB      0CDH;
                                          DW      P1;
CMPMY     MACRO P1;                       ENDM;
                                          DB      0C9H;
                                          DW      P1;
CMPIX     MACRO P1;                       ENDM;
                                          DB      0C1H,P1;
CMPIY     MACRO P1;                       ENDM;
                                          DB      0C1H,P1;
CPXIM     MACRO P1;                       ENDM;
                                          DB      0E0H,P1;
CPXZ      MACRO P1;                       ENDM;
                                          DB      0E4H,P1;
CPXM      MACRO P1;                       ENDM;
                                          DB      0ECH;
                                          DW      P1;
CPYIM     MACRO P1;                       ENDM;
                                          DB      0C0H,P1;
CPYZ      MACRO P1;                       ENDM;
                                          DB      0C4H,P1;
CPYM      MACRO P1;                       ENDM;
                                          DB      0CCH;
                                          DW      P1;
                                          ENDM;
;
;         DECREMENT MACROS
;
DECZ      MACRO P1;
                                          DB      0C6H,P1;
                                          ENDM;
DECZX     MACRO P1;
                                          DB      0C6H,P1;
                                          ENDM;
```

```
217                     DECM      MACRO P1;
218                                                   DB      0CEH;
219                                                   DW      P1;
220                                                   ENDM;
221                     DECMX     MACRO P1;
222                                                   DB      0CEH;
223                                                   DW      P1;
224                                                   ENDM;
225                     DEX       MACRO;
226                                                   DB      0CAH;
227                                                   ENDM;
228                     DEY       MACRO;
229                                                   DB      88H;
230                                                   ENDM;
231                     ;
232                     ;         EXCLUSIVE OR MACROS
233                     ;
234                     EORIM     MACRO P1;
235                                                   DB      49H,P1;
236                                                   ENDM;
237                     EORZ      MACRO P1;
238                                                   DB      45H,P1;
239                                                   ENDM;
240                     EORZX     MACRO P1;
241                                                   DB      55H,P1;
242                                                   ENDM;
243                     EORM      MACRO P1;
244                                                   DB      4CH;
245                                                   DW      P1;
246                                                   ENDM;
247                     EORMX     MACRO P1;
248                                                   DB      5CH;
249                                                   DW      P1;
250                                                   ENDM;
251                     EORMY     MACRO P1;
252                                                   DB      59H;
253                                                   DW      P1;
254                                                   ENDM;
255                     EORIX     MACRO P1;
256                                                   DB      41H,P1;
257                                                   ENDM;
258                     EORIY     MACRO P1;
259                                                   DB      51H,P1;
260                                                   ENDM;
261                     ;
262                     ;         INCREMENT MACROS
263                     ;
264                     INCZ      MACRO P1;
265                                                   DB      0E6H,P1;
266                                                   ENDM;
267                     INCZX     MACRO P1;
268                                                   DB      0F6H,P1;
269                                                   ENDM;
270                     INCM      MACRO P1;
```

```
                                                DB      0EEH;
                                                DW      P1;
                                                ENDM;
INCMX     MACRO P1;
                                                DB      0FEH;
                                                DW      P1;
                                                ENDM;
INXX      MACRO;
                                                DB      0E8H;
                                                ENDM;
INYY      MACRO;
                                                DB      0C8H;
                                                ENDM;
;
;         JUMP MACROS
;
JMPM      MACRO P1;
                                                DB      4CH;
                                                DW      P1;
                                                ENDM;
JMPI      MACRO P1;
                                                DB      6CH;
                                                DW      P1;
                                                ENDM;
JSRM      MACRO P1;
                                                DB      2CH;
                                                DW      P1;
                                                ENDM;
;
;         LOAD MACROS
;
LDAIM     MACRO P1;
                                                DB      0A9H,P1;
                                                ENDM;
LDAZ      MACRO P1;
                                                DB      0A5H,P1;
                                                ENDM;
LDAZX     MACRO P1;
                                                DB      0B5H,P1;
                                                ENDM;
LDAM      MACRO P1;
                                                DB      0ADH;
                                                DW      P1;
                                                ENDM;
LDAMX     MACRO P1;
                                                DB      0BDH;
                                                DW      P1;
                                                ENDM;
LDAMY     MACRO P1;
                                                DB      0B9H;
                                                DW      P1;
                                                ENDM;
LDAIX     MACRO P1;
                                                DB      0A1H,P1;
```

```
LDAIY     MACRO P1;
                                        ENDM;
                                        DB      0B1H,P1;
                                        ENDM;
LDXIM     MACRO P1;
                                        DB      0A2H,P1;
                                        ENDM;
LDXZ      MACRO P1;
                                        DB      0A6H,P1;
                                        ENDM;
LDXZY     MACRO P1;
                                        DB      0B6H,P1;
                                        ENDM;
LDXM      MACRO P1;
                                        DB      0AEH;
                                        DW      P1;
                                        ENDM;
LDXMY     MACRO P1;
                                        DB      0BEH;
                                        DW      P1;
                                        ENDM;
LDYIM     MACRO P1;
                                        DB      0A0H,P1;
                                        ENDM;
LDYZ      MACRO P1;
                                        DB      0A4H,P1;
                                        ENDM;
LDYZX     MACRO P1;
                                        DB      0B4H,P1;
                                        ENDM;
LDYM      MACRO P1;
                                        DB      0ACH;
                                        DW      P1;
                                        ENDM;
LDYMX     MACRO P1;
                                        DB      0BCH;
                                        DW      P1;
                                        ENDM;
;
;         LOGICAL SHIFT RIGHT MACROS
;
LSRA      MACRO;
                                        DB      4AH;
                                        ENDM;
LSRZ      MACRO P1;
                                        DB      46H,P1;
                                        ENDM;
LSRZX     MACRO P1;
                                        DB      56H,P1;
                                        ENDM;
LSRM      MACRO P1;
                                        DB      4EH;
                                        DW      P1;
                                        ENDM;
```

```
LSRMX     MACRO P1;
                                        DB     5EH;
                                        DW     P1;
                                        ENDM;
;
;         NC OPERATION MACRO
;
NOOP      MACRO;
                                        DB     0EAH;
                                        ENDM;
;
;         OR MACROS
;
ORAIM     MACRO P1;
                                        DB     09H,P1;
                                        ENDM;
ORAZ      MACRO P1;
                                        DB     05H,P1;
                                        ENDM;
ORAZX     MACRO P1;
                                        DB     15H,P1;
                                        ENDM;
ORAM      MACRO P1;
                                        DB     0EH;
                                        DW     P1;
                                        ENDM;
ORAMX     MACRO P1;
                                        DB     1DH;
                                        DW     P1;
                                        ENDM;
ORAMY     MACRO P1;
                                        DB     19H;
                                        DW     P1;
                                        ENDM;
ORAIX     MACRO P1;
                                        DB     01H,P1;
                                        ENDM;
ORAIY     MACRO P1;
                                        DB     11H,P1;
                                        ENDM;
;
;         PUSH  MACROS
;
PHA       MACRO;
                                        DB     48H;
                                        ENDM;
PHP       MACRO;
                                        DB     08H;
                                        ENDM;
;
;         POP MACROS
;
PLA       MACRO;
                                        DB     68H;
                                        ENDM;
```

```
PLP       MACRO;
                                        DB      28H;
                                        ENDM;
;
;         ROTATE MACROS
;
ROLA      MACRO;
                                        DB      2AH;
                                        ENDM;
ROLZ      MACRO P1;
                                        DB      26H,P1;
                                        ENDM;
ROLZX     MACRO P1;
                                        DB      36H,P1;
                                        ENDM;
ROLM      MACRO P1;
                                        DB      2EH;
                                        DW      P1;
                                        ENDM;
ROLMX     MACRO P1;
                                        DB      3EH;
                                        DW      P1;
                                        ENDM;
RORA      MACRO;
                                        DB      6AH;
                                        ENDM;
RORZ      MACRO P1;
                                        DB      66H,P1;
                                        ENDM;
RORZX     MACRO P1;
                                        DB      76H,P1;
                                        ENDM;
RORM      MACRO P1;
                                        DB      6EH;
                                        DW      P1;
                                        ENDM;
RORMX     MACRO P1;
                                        DB      7EH;
                                        DW      P1;
                                        ENDM;
;
;         RETURN MACROS
;
RTI       MACRO;
                                        DB      4CH;
                                        ENDM;
RTS       MACRO;
                                        DB      6CH;
                                        ENDM;
;
;         SUBTRACT WITH BORROW MACROS
;
SBCIM     MACRO P1;
                                        DB      0E9H,P1;
```

```
                                                    ENDM;
SBCZ      MACRO P1;
                                                    DB      0E5H,P1;
                                                    ENDM;
SBCZX     MACRO P1;
                                                    DB      0F5H,P1;
                                                    ENDM;
SBCM      MACRO P1;
                                                    DB      0EDH;
                                                    DW      P1;
                                                    ENDM;
SBCMX     MACRO P1;
                                                    DB      0FDH;
                                                    DW      P1;
                                                    ENDM;
SBCMY     MACRO P1;
                                                    DB      0F9H;
                                                    DW      P1;
                                                    ENDM;
SBCIX     MACRO P1;
                                                    DB      0E1H,P1;
                                                    ENDM;
SBCIY     MACRO P1;
                                                    DB      0F1H,P1;
                                                    ENDM;
;
;         SET CONTROL AND CONDITION BITS
;
SEC       MACRO;
                                                    DB      38H;
                                                    ENDM;
SED       MACRO;
                                                    DB      0F8H;
                                                    ENDM;
SEI       MACRO;
                                                    DB      078H;
                                                    ENDM;
;
;         STORE MACROS
;
STAZ      MACRO P1;
                                                    DB      85H,P1;
                                                    ENDM;
STAZX     MACRO P1;
                                                    DB      95H,P1;
                                                    ENDM;
STAM      MACRO P1;
                                                    DB      8CH;
                                                    DW      P1;
                                                    ENDM;
STAMX     MACRO P1;
                                                    DB      9CH;
                                                    DW      P1;
                                                    ENDM;
```

```
542                                 STAMY     MACRO P1
543                                                                 DB      99H;
544                                                                 DW      P1;
545                                                                 ENDM;
546                                 STAIX     MACRO P1;
547                                                                 DB      81H,P1;
548                                                                 ENDM;
549                                 STAIY     MACRO P1;
550                                                                 DB      91H,P1;
551                                                                 ENDM;
552                                 STXZ      MACRO P1;
553                                                                 DB      86H,P1;
554                                                                 ENDM;
555                                 STXZY     MACRO P1;
556                                                                 DB      96H,P1;
557                                                                 ENDM;
558                                 STXM      MACRO P1;
559                                                                 DB      8EH;
560                                                                 DW      P1;
561                                                                 ENDM;
562                                 STYZ      MACRO P1;
563                                                                 DB      84H,P1;
564                                                                 ENDM;
565                                 STYZX     MACRO P1;
566                                                                 DB      94H,P1;
567                                                                 ENDM;
568                                 STYM      MACRO P1;
569                                                                 DB      8CH;
570                                                                 DW      P1;
571                                                                 ENDM;
572                                 ;
573                                 ;         TRANSFER MACROS
574                                 ;
575                                 TAX       MACRO;
576                                                                 DB      0AAH;
577                                                                 ENDM;
578                                 TAY       MACRO;
579                                                                 DB      0A8H;
580                                                                 ENDM;
581                                 TYA       MACRO;
582                                                                 DB      98H;
583                                                                 ENDM;
584                                 TSX       MACRO;
585                                                                 DB      0BAH;
586                                                                 ENDM;
587                                 TXA       MACRO;
588                                                                 DB      8AH;
589                                                                 ENDM;
590                                 TXS       MACRO;
591                                                                 DB      9AH;
592                                                                 ENDM;
593       1780                                ORG   1780H;
594                                 ;
595                                 ;
```

```
596                                  ;  ***   SET UP INTERRUPT RETURN VECTORS.
597                                  ;
598                                  ;
599                                  ;  **    LINES OF CODING WITH '??' BEFORE THE COMMENTS ARE USED TO SET
600                                  ;        INTERRUPT VECTORS FOR THE 'KIM' MONITOR PROGRAM.  THESE LINES
601                                  ;        OF CODING ARE NOT PART OF THE 'POPS' CONTROL ROUTINE.
602                                  ;
603                                  ;  **    ENTER HERE UPON INITIALLY LOADING KIM FROM TAPE.
604                                  ;
605      1780                                LDAIM 0C;                 ??  GET NMI VECTOR AND STORE IT
605+     1780 A90C                                                           DB    0A9H,(0C);
606      1782                                STAM  17FAH;              ??
606+     1782 8D                                                             DB    8DH;
606+     1783 FA17                                                           DW    (17FAH);
607      1785                                LDAIM 1CH;                ??
607+     1785 A91C                                                           DB    0A9H,(1CH);
608      1787                                STAM  17FBH;              ??
608+     1787 8D                                                             DB    8DH;
608+     1788 FB17                                                           DW    (17FBH);
609      178A                                LDAM  IRQ;                ??  GET INTERRUPT VECTOR AND STORE IT
609+     178A AD                                                             DB    0ADH;
609+     178B 9917                                                           DW    (IRQ);
610      178D                                STAM  17FEH;              ??
610+     178D 8D                                                             DB    8DH;
610+     178E FE17                                                           DW    (17FEH);
611      1790                                LDAM  IRQ+1;              ??
611+     1790 AD                                                             DB    0ADH;
611+     1791 9A17                                                           DW    (IRQ+1);
612      1793                                STAM  17FFH;              ??
612+     1793 8D                                                             DB    8DH;
612+     1794 FF17                                                           DW    (17FFH);
613      1796                                JMPM  START;              ??  GO TO START OF PROGRAM
613+     1796 4C                                                             DB    4CH;
613+     1797 2F00                                                           DW    (START);
614                                  ;                                 ??
615      1799 6100                   IRQ:    DW    IRQST;              ??
616                                  ;
617                                  ;EJECT
618                                  ;
619      1600                                ORG   1600H;
620                                  ;
621                                  ;       DEFINE ADDRESSES FOR I/O CONTROL
622                                  ;
623      1600                        MORB:   DS    1;                  MEM + I/O REGISTER B
624      1601                        MORA:   DS    1;                  MEM + I/O REGISTER A
625      1602                        MDDRB:  DS    1;                  MEM + DATA DIRECTION REG. B
626      1603                        MDDRA:  DS    1;                  MEM + DATA DIRECTION REG. A
627      1605                                ORG   1608H;
628      1608                        ACR:    DS    1;                  AUX. CONTROL REG.
629      160C                        PCR:    DS    1;                  PERIPHERAL CONT. REG.
630      160D                        IFR:    DS    1;                  INTERRUPT FLAG REG.
631      160E                        IER:    DS    1;                  INTERRUPT ENABLE REG.
632      1700                                ORG   1700H;
633      1700                        PAD:    DS    1;                  KIM I/O REGISTER A
```

```
1701
1702
1703
1704
1705
1706
1707
170C
170C
170D
170E
170F

C000


0000 00
0001 00
0002 00
0003 00
0004 00
0005 00
0006 00
0007 00
0008 00
0009 00
000A 00
000B 00
000C 00
000D 00
000E 00
000F 00
0010 00
0011 03
0012 03
0013 03
0014 03
0015 03
0016 04
0017 04
0018 04
0019 04
001A 04
001B 00
001C 00
001D 00
001E 00
001F 00
0020 00
0021 00
0022 00
0023 00
0024 00
```

```
PADC:     DS    1;                    KIM DATA DIRECTION REG. A
PBD:      DS    1;                    KIM I/O REGISTER B
PBDC:     DS    1;                    KIM DATA DIRECTION REG. B
TX1:      DS    1;                    TIMER DIV. BY 1, NO INTERRUPT
TX8:      DS    1;                    TIMER DIV. BY 8, NO INTERRUPT
TX64:     DS    1;                    TIMER DIV. BY 64, NO INTERRUPT
TX024:    DS    1;                    TIMER DIV. BY 1024, NO INTERRUPT
          ORG   170CH;
ITX1:     DS    1;                    TIMER DIV. BY 1, ENABLE INTERRUPT
ITX8:     DS    1;                    TIMER DIV. BY 8,   "        "
ITX64:    DS    1;                    TIMER DIV. BY 64,  "        "
ITX24:    DS    1;                    TIMER DIV. BY 1024  "       "
;
          ORG C000H;
;
;  ***    CONSTANTS, SWITCHES AND FLAGS STORAGE AREA
;
LPC:      DB    0;                    LINE PLUSE COUNTER
LENSW:    DB    0;                    LENGTH SWITCH VALUE
OLDTI:    DB    0;                    OLD TIME CNT
TIME1:    DB    0;                    TIME 1 CNT
TIME2:    DB    0;                    TIME 2 CNT
TIME3:    DB    0;                    TIME 3 CNT
TIME4:    DB    0;                    TIME 4 CNT
NEWTI:    DB    0;                    NEW TIME CNT
TOTIM:    DB    0;                    TOTAL TIME CNT
INCR1:    DB    0;                    INCREMENT 1 - HALF INCH IN NO. OF LINES
INCR2:    DB    0;                    INCREMENT 2 - 1/4 INCH VALUE
TLEN:     DB    0;                    FORM LENGTH IN NO. OF LINES
INCH:     DB    0;                    INCH CNT IN NO. OF.LINES
ULCNT:    DB    0;                    UNLOAD TIME OUT COUNTER
STRT1:    DB    0;                    START 1 CNT
STRT2:    DB    0;                    START 2 CNT
STRT3:    DB    0;                    START 3 CNT
ADJA6:    DB    3;                    ADJ. A VALUE - 6 LPI
ADJB6:    DB    3;                    ADJ. B VALUE - 6 LPI
ADJC6:    DB    3;                    ADJ. C VALUE - 6 LPI
ADJD6:    DB    3;                    ADJ. D VALUE - 6 LPI
ADJE6:    DB    3;                    ADJ. E VALUE - 6 LPI
ADJA8:    DB    4;                    ADJ. A VALUE - 8 LPI
ADJB8:    DB    4;                    ADJ. B VALUE - 8 LPI
ADJC8:    DB    4;                    ADJ. C VALUE - 8 LPI
ADJD8:    DB    4;                    ADJ. D VALUE - 8 LPI
ADJE8:    DB    4;                    ADJ. E VALUE - 8 LPI
SPA:      DB    0;                    10 IPS SWITCH CNT
SPB:      DB    0;                    20 IPS SWITCH CNT
SPC:      DB    0;                    30 IPS SWITCH CNT
SPD:      DB    0;                    40 IPS SWITCH CNT
SPE:      DB    0;                    50 IPS SWITCH CNT
ULSW:     DB    0;
SWB:      DB    0;
SWC:      DB    0;
SWD:      DB    0;
SWE:      DB    0;
```

```
0025 00          EI:      DB    0;          EXPECT TIMER INT. FLAG
0026 00          TF:      DB    0;          TIMER INT. FLAG
0027 00          EOF:     DB    0;          END OF FORM FLAG
0028 00          SOLSF:   DB    0;          SOLENOID SWITCHED FLAG
0029 00          SWFE:    DB    0;          SWITCH FLAG E
002A 00          SWFD:    DB    0;             "      "  D
002B 00          SWFC:    DB    0;             "      "  C
002C 00          SWFB:    DB    0;             "      "  B
002D 00          SWFA:    DB    0;             "      "  A
002E 00          LPI8:    DB    0;          8 LPI FLAG
                 ;EJECT
                 ;
                 ;  **    START OF PROGRAM.
                 ;        WILL RETURN HERE IF POFS 'RESET' SWITCH IS PRESSED OR 1 SECOND
                 ;        AFTER FORMS ARE RUN OUT AFTER PRESSING THE 'UNLOAD' SWITCH.
                 ;
002F             START:   SEI;                DISABLE INTERRUPTS
002F 78                                             DB    078H;
0030             CLD;                        CLEAR DECIMAL MODE
0030 D8                                             DB    0D8H;
0031             LDAIM 13H;
0031 A913                                           DB    0A9H,(13H);
0033             STAM  PADD;                 SET KIM 'A' DATA DIRECTION REG.
0033 8D                                             DB    8DH;
0034 0117                                           DW    (PADD);
                 ;
                 ;  **    KIM 'A' I/O REGISTER IS CONFIGURED AS FOLLOWS:
                 ;
                 ;        BIT 0 - OUT - BACK SOLENOID
                 ;        BIT 1 - OUT - FRONT SOLENOID
                 ;        BIT 4 - OUT - FORMS LOADED INDICATOR
                 ;        BIT 7 - IN - 8 LPI SIGNAL
                 ;
                 ;
                 ;  **    MEM + INTERRUPT FLAG REGISTER ENABLE
                 ;
0036             LDAIM 83H;
0036 A983                                           DB    0A9H,(83H);
0038             STAM  IER;                  SET ENABLE INT. FOR CA1 & CA2
0038 8D                                             DB    8DH;
0039 0E16                                           DW    (IER);
                 ;
                 ;  ***   CA1 = RESET SWITCH INTERRUPT
                 ;        CA2 = LINE PULSE INTERRUPT
                 ;
003B             LDAM  IFR;
003B AD                                             DB    0ADH;
003C 0D16                                           DW    (IFR);
003E             STAM  IFR;                  CLEAR INTERRUPT FLAGS
003E 8D                                             DB    8DH;
003F 0D16                                           DW    (IFR);
0041             LDAIM 0;
0041 A900                                           DB    0A9H,(0);
0043             STAM  PBDD;                 SET KIM DATA DIRECTION 'B'
```

```
728+    0043 8D                                          DB     8DH;
728+    0044 0317                                        DW     (PBCD);
729
730                                     ;
731                                     ;  **   KIM 'B' I/O REG. IS USED ONLY FOR THE TIMER INTERRUPT ON BIT 7
732     0046                            ;
732+    0046 8D                                 STAM  MDDRA;          SET M+ DATA DIRECTION REGISTER A
732+    0047 0316                                        DB   * 8DH;
733                                                      DW     (MDDRA);
734                                     ;
735                                     ;  **   THE M+ 'A' REGISTER IS CONFIGURED AS FOLLOWS:
736                                     ;
737                                     ;       BIT 0 - IN - LENGTH SWITCH VALUE = 1
738                                     ;       BIT 1 - IN - LENGTH SWITCH VALUE = 2
739                                     ;       BIT 2 - IN - LENGTH SWITCH VALUE = 4
740                                     ;       BIT 3 - IN - LENGTH SWITCH VALUE = 8
741                                     ;       BIT 4 - IN - LENGTH SWITCH VALUE = 16
742                                     ;
743                                     ;       BITS 0 TO 4 ALL ZEROES, ASSUME A MINIMUM FORM LENGTH OF 6 INCHES.
744                                     ;
745                                     ;       BIT 5 - IN - CUT-FOLD SWITCH ( 0 = 1ST FOLD IS CUT-FOLD)
746                                     ;       BIT 6 - IN - UNLOAD SWITCH
747                                     ;       BIT 7 - IN - PAPER DETECTION PHOTO-CELL
748     0049                            ;
748+    0049 8D                                 STAM  PCR;            SET CA1 &.CA2 INT. TRANSITION LOW
748+    004A 0C16                                        DB     8DH;
749     004C                                             DW     (PCR);
749+    004C 85DD                               STAZ  ULCNT;          CLEAR 'UNLOAD' TIMER CNT
750     004E                                             DB     85H,(ULCNT);
750+    004E A20F                               LDXIM 15;
751     0050                                             DB     0A2H,(15);
751+    0050 A94C                               LDAIM 64;             CONSTANT TO RESET SWITCHES
752     0052                                             DB     0A9H,(64);
752+    0052 951F                       SETLP:  STAZX ULSW-1;         CLEAR ALL SWITCHES AND FLAGS
753     0054                                             DB     95H,(ULSW-1);
753+    0054 CA                                 DEX;                  DECR. X
754     0055                                             DB     0CAH;
754+    0055 DCFB                               BNE   SETLP;          NOT ZERO, DO MORE
755     0057                                             DB     0D0H,(SETLP)-$-2;
755+    0057 20                                 JSRM  TIFIL;          GO SUB TO SET UP TIME CNTS
755+    0058 5401                                        DB     20H;
756     005A                                             DW     (TIFIL);
756+    005A 58                                 CLI;                  ENABLE INTERRUPTS
757     005B                                             DB     58H;
757+    0058 4C                         WAIT:   JMPM  $-1;            WAIT FOR INTERRUPT
757+    005C 5B0C                                        DB     4CH;
758     005E                                             DW     ($-1);
758+    005E 4C                                 JMPM  $-4;
758+    005F 5B00                                        DB     4CH;
759                                                      DW     ($-4);
760                                     ;
761                                     ;  **   INTERRUPT SERVICE ROUTINE
762     0061                            ;
762+    0061 AC                         IRQST:  LDAM  IFR;            INTERRUPT FROM LINE PULSE OR 'RESET' SWITCH?
                                                         DB     0ADH;
```

```
762+    0062 0D16
763     0064
763+    0064 1007
764     0066
764+    0066 6A
765     0067
765+    0067 B00C
766     0069
766+    0069 6A
767     006A
767+    006A B01F
768     006C
768+    006C 40
769     006D
769+    006D 2C
769+    006E 0717
770     0070
770+    0070 10FA
771     0072
771+    0072 4C
771+    0073 0001
772     0075
772+    0075 A901
773     0077
773+    0077 8D
773+    0078 0D16
774     007A
774+    007A 2423
775     007C
775+    007C 3007
776     007E
776+    007E 2421
777     0080
777+    0080 3006
778     0082
778+    0082 4C
778+    0083 0002
779     0085
779+    0085 4C
779+    0086 2F03
780     0088
780+    0088 4C
780+    0089 C702
781     008B
781+    008B A902
782     008D
782+    008D 8D
782+    008E 0D16
783     0090
783+    0090 A2FF
784     0092
784+    0092 9A
785     0093
785+    0093 A900
```

```
                BPL   TICK;          DW    (IFR);
                                     NC, GO AROUND
                                     DB    1CH,(TICK)-$-2;
                RCRA;                IS IT LINE PULSE?
                                     DB    6AH;
                BCS   LPINT;         YES, GO AROUND
                                     DB    0B0H,(LPINT)-$-2;
                RCRA;                IS IT RESET SWITCH?
                                     DB    6AH;
                BCS   RSINT;         YES, GO AROUND
                                     DB    0B0H,(RSINT)-$-2;
LPRS:           RTI;                 INVALID INT., GO WAIT FOR ANOTHER
                                     DB    4CH;
TICK:           BITM  TX024;         INT. FROM TIMER
                                     DB    2CH;
                                     DW    (TX024);
                BPL   LPRS;          NO, GO AROUND
                                     DB    1CH,(LPRS)-$-2;
                JMPM  TINT;          GO TO TIMER INT PROCESSING
                                     DB    4CH;
                                     DW    (TINT);
LPINT:          LDAIM 1;
                                     DB    0A9H,(1);
                STAM  IFR;           CLEAR LINE PULSE FLAG
                                     DB    8CH;
                                     DW    (IFR);
                BITZ  SWD;           SW D SET?
                                     DB    24H,(SWD);
                BMI   LPIA;          YES, GO TO FAST LINE PULSE PROCESSING
                                     DB    3CH,(LPIA)-$-2;
                BITZ  SWB;           SW B SET ?
                                     DB    24H,(SWB);
                BMI   LPIB;          YES, GO TO LOAD 1ST TWO PAGES
                                     DB    3CH,(LPIB)-$-2;
                JMPM  INTLP;         GO TO INITIAL LOAD OF FORMS
                                     DB    4CH;
                                     DW    (INTLP);
LPIA:           JMPM  FLP;           GO TO FAST LINE PROCESSING
                                     DB    4CH;
                                     DW    (FLP);
LPIB:           JMPM  LOAD2;         GO TO LOAD FIRST TWO PAGES
                                     DB    4CH;
                                     DW    (LOAD2);
RSINT:          LDAIM 2;
                                     DB    0A9H,(2);
                STAM  IFR;           CLEAR 'RESET' SWITCH FLAG
                                     DB    8CH;
                                     DW    (IFR);
RSINX:          LDXIM 0FFH;          'FF' TO X
                                     DB    0A2H,(0FFH);
                TXS;                 RESET STACK POINTER
                                     DB    9AH;
                LDAIM 0;
                                     DB    0A9H,(0);
```

```
786      0095                          STAM  PAD;              TURN OFF SOLENOIDS
786+     0095 8D                                                     DB    8CH;
786+     0096 0017                                                   DW    (PAD);
787      0098                          JMPM  START;            GO START OVER
787+     0098 4C                                                     DB    4CH;
787+     0099 2F00                                                   DW    (START);
788                                ;
789                                ;  ***  RESET SWITCH FLAGS AND THEN SET THE ONES THAT ARE VALID
790                                ;       WILL ENTER HERE ALSO FROM TIMER INTERRUPT PROCESSING
791                                ;
792      009B                      SPENT:  LDAIM 64;               CONSTANT FOR SWITCH RESET
792+     009B A940                                                   DB    0A9H,(64);
793      009D                          STAZ  SWFA;             CLEAR SWITCH FLAGS
793+     009D 852D                                                   DB    85H,(SWFA);
794      009F                          STAZ  SWFB;
794+     009F 852C                                                   DB    85H,(SWFB);
795      00A1                          STAZ  SWFC;
795+     00A1 852B                                                   DB    85H,(SWFC);
796      00A3                          STAZ  SWFD;
796+     00A3 852A                                                   DB    85H,(SWFD);
797      00A5                          STAZ  SWFE;
797+     00A5 8529                                                   DB    85H,(SWFE);
798      00A7                          LDAZ  TOTIM;            GET TOTAL TIME
798+     00A7 A508                                                   DB    0A5H,(TOTIM);
799      00A9                          CMPIM 10;               TIME < 10? - 50 IPS
799+     00A9 C90A                                                   DB    0C9H,(10);
800      00AB                          BCC   SPD5;             YES, GO AROUND
800+     00AB 9022                                                   DB    9CH,(SPD5)-$-2;
801      00AD                          CMPIM 14;               TIME < 14? - 40 IPS
801+     00AD C90E                                                   DB    0C9H,(14);
802      00AF                          BCC   SPD4;             YES, GO AROUND
802+     00AF 9020                                                   DB    9CH,(SPD4)-$-2;
803      00B1                          CMPIM 18;               TIME < 18? - 30 IPS
803+     00B1 C912                                                   DB    0C9H,(18);
804      00B3                          BCC   SPD3;             YES, GO AROUND
804+     00B3 901E                                                   DB    9CH,(SPD3)-$-2;
805      00B5                          CMPIM 26;               TIME < 26? - 20 IPS
805+     00B5 C91A                                                   DB    0C9H,(26);
806      00B7                          BCC   SPD2;             YES, GO AROUND
806+     00B7 901C                                                   DB    9CH,(SPD2)-$-2;
807      00B9                          CMPIM 50;               TIME < 50 - 10 IPS
807+     00B9 C932                                                   DB    0C9H,(50);
808      00BB                          BCC   SPD1;             YES, GO AROUND
808+     00BB 901A                                                   DB    9CH,(SPD1)-$-2;
809      00BD                          CMPIM 97;               TIME > 96? - SLOW SPEED
809+     00BD C961                                                   DB    0C9H,(97);
810      00BF                          BCC   SPOUT;            NO, RETURN
810+     00BF 9018                                                   DB    9CH,(SPOUT)-$-2;
811                                ;
812                                ;  ***  FORMS ARE AT SLOW SPEED.  IF SOLENOIDS HAVE ALREADY BEEN
813                                ;       SWITCHED BEFORE THE END OF THE FORM, THEN SWITCH THEM
814                                ;       BACK AGAIN
815                                ;
816      00C1                          BITZ  SOLSF;            SOLENOIDS SWITCHED?
```

```
816+    00C1 2428                                   DB     24H,(SOLSF);
817     00C3                  BPL   SPOUT;          NC, GO RETURN
817+    00C3 1014                                   DB     1CH,(SPOUT)-$-2;
818     00C5                  BITZ  EOF;            YES, IS IT END OF FORMS YET?
818+    00C5 2427                                   DB     24H,(EOF);
819     00C7                  BMI   SPOUT;          YES, GO RETURN
819+    00C7 3010                                   DB     3CH,(SPOUT)-$-2;
820     00C9                  LSRZ  SOLSF;          RESET SOLENOIDS SWITCHED FLAG
820+    00C9 4628                                   DB     46H,(SOLSF);
821     00CB                  JSRM  SWSOL;          GO SWITCH SOLENOIDS BACK
821+    00CB 20                                     DB     2CH;
821+    00CC 6901                                   DW     (SWSOL);
822     00CE                  RTS;                  RETURN FROM SUBROUTINE
822+    00CE 60                                     DB     6CH;
823     00CF          SPD5:   ASLZ  SWFE;           SET SWITCH FLAG E
823+    00CF 0629                                   DB     06H,(SWFE);
824     00D1          SPD4:   ASLZ  SWFD;           SET SWITCH FLAG D
824+    00D1 062A                                   DB     06H,(SWFD);
825     00D3          SPD3:   ASLZ  SWFC;           SET SWITCH FLAG C
825+    00D3 062B                                   DB     06H,(SWFC);
826     00D5          SPD2:   ASLZ  SWFB;           SET SWITCH FLAG B
826+    00D5 062C                                   DB     06H,(SWFB);
827     00D7          SPD1:   ASLZ  SWFA;           SET SWITCH FLAG A
827+    00D7 062D                                   DB     06H,(SWFA);
828     00D9          SPOUT:  RTS;                  RETURN FROM SUBROUTINE
828+    00D9 60                                     DB  *  6CH;
829                   ;
830     0100                  ORG   100H;
831                   ;
832                   ;
833                   ;
834                   ;  ***  TIMER INTERRUPT HANDLING.  IF INTERRUPT EXPECTED BECAUSE
835                   ;       OF BEING SET BY A LINE PULSE INTERRUPT, THEN CLEAR SPEED
836                   ;       COUNTS AND TIMES BACK TO STARTING POINT.  IF SOLENOIDS
837                   ;       HAVE BEEN SWITCHED BEFORE THE END OF THE FORM, THEN
838                   ;       SWITCH THEM BACK AGAIN.
839                   ;
840     0100          TINT:   LDAM  TX64;           READ TIMER, DISABLE IRQ
840+    0100 AD                                     DB     0ADH;
840+    0101 0617                                   DW     (TX64);
841     0103                  BITZ  EI;             TIMER INT EXPECTED FROM LINE PULSE SET?
841+    0103 2425                                   DB     24H,(EI);
842     0105                  BPL   TINA;           NC, GO AROUND
842+    0105 1012                                   DB     1CH,(TINA)-$-2;
843     0107                  LSRZ  EI;             RESET EXPECTED INT FLAG
843+    0107 4625                                   DB     46H,(EI);
844     0109                  LDAIM 128;
844+    0109 A980                                   DB     0A9H,(128);
845     010B                  STAZ  TF;             SET TIMER FLAG
845+    010B 8526                                   DB     85H,(TF);
846     010D                  JSRM  TIFIL;          GO SUB TO INITIALIZE TIMER
846+    010D 20                                     DB     2CH;
846+    010E 5401                                   DW     (TIFIL);
847     0110                  JSRM  SPENT;          GO SUB TO CHECK SPEED
```

```
847+    0110 20                                          DB     2CH;
847+    0111 9B00                                        DW     (SPENT);
848     0113                    TINB:   LDAIM 100;
848+    0113 A964                                        DB     0A9H,(100);
849     0115                            STAM  ITX24;     LOAD TIMER: 100 X 1,024 - ENABLE INT
849+    0115 8D                                          DB     8DH;
849+    0116 0F17                                        DW     (ITX24);
850     0118                            RTI;             GO WAIT FOR INTERRUPT
850+    0118 40                                          DB     4DH;
851     0119                    TINA:   BITM  MORA;      IS 'UNLOAD' SWITCH DEPRESSED?
851+    0119 2C                                          DB     2CH;
851+    011A 0116                                        DW     (MORA);
852     011C                            BVS   TIND;      NC, GO AROUND
852+    011C 7014                                        DB     7DH,(TIND)-$-2;
853     011E                            LDAIM 128;       YES, SWITCH DEPRESSED
853+    011E A980                                        DB     0A9H,(128);
854     0120                            STAZ  ULSW;      SET UNLOAD FLAG
854+    0120 8520                                        DB     85H,(ULSW);
855     0122                            LDAM  PAD;       GET OUTPUT REGISTER
855+    0122 AD                                          DB     0ADH;
855+    0123 0017                                        DW     (PAD);
856     0125                            ANDIM 1C;        MASK OUT SOLENOID CONTROL BITS
856+    0125 290A                                        DB     29H,(10);
857     0127                            STAM  PAD;       TURN OFF SOLENOIDS
857+    0127 8D                                          DB     8DH;
857+    0128 0017                                        DW     (PAD);
858     012A                            LDAIM 1;
858+    012A A901                                        DB     0A9H,(1);
859     012C                            STAM  IER;       PREVENT LINE PULSE INTERRUPTS
859+    012C 8D                                          DB     8DH;
859+    012D 0E16                                        DW     (IER);
860     012F                            JMPM  TINB;      GO SET TIMER AGAIN
860+    012F 4C                                          DB     4CH;
860+    0130 1301                                        DW     (TINB);
861     0132                    TIND:   BITZ  ULSW;      UNLOAD FLAG SET?
861+    0132 2420                                        DB     24H,(ULSW);
862     0134                            BMI   $+5;       YES, JUMP OVER
862+    0134 3003                                        DB     3DH,($+5)-$-2;
863     0136                            JMPM  TINB;      NC, GO SET TIMER AGAIN
863+    0136 4C                                          DB     4CH;
863+    0137 1301                                        DW     (TINB);
864     0139                            LDAM  MORA;      IS PHOTOCELL COVERED?
864+    0139 AD                                          DB     0ADH;
864+    013A 0116                                        DW     (MORA);
865     013C                            BMI   TINE;      NC, GO AROUND
865+    013C 3007                                        DB     3DH,(TINE)-$-2;
866     013E                            LDAIM 30;        YES, SET UP FOR 3 SECOND DELAY
866+    013E A91E                                        DB     0A9H,(30);
867     0140                            STAZ  ULCNT;     SET UNLOAD TIME-OUT COUNTER
867+    0140 850D                                        DB     85H,(ULCNT);
868     0142                            JMPM  TINB;      GO SET TIMER
868+    0142 4C                                          DB     4CH;
868+    0143 1301                                        DW     (TINB);
869     0145                    TINE:   DECZ  ULCNT;     DECREMENT TIME-OUT COUNTER
```

```
869+    0145 C60D                                   DB    0C6H,(ULCNT);
870     0147                    BNE   $+5;          CNT = ZERO?
870+    0147 0003                                   DB    0C0H,($+5)-$-2;
871     0149                    JMPM  TINB;         NC, GO SET TIMER AGAIN
871+    0149 4C                                     DB    4CH;
871+    014A 1301                                   DW    (TINB);
872     014C                    LDAIM 0;
872+    014C A900                                   DB    0A9H,(0);
873     014E                    STAM  PAD;          TURN OFF ALL BITS
873+    014E 8D                                     DB    8DH;
873+    014F 0017                                   DW    (PAD);
874     0151                    JMPM  RSINX;        GO START OVER
874+    0151 4C                                     DB    4CH;
874+    0152 9000                                   DW    (RSINX);
875                     ;  **   INITIALIZE TIME CNTS AND TOTAL TIME VALLES SO AS TO
876                     ;       ASSUME SLOW SPEED OPERATION UP TO THIS POINT
877                     ;
878     0154            TIFIL:  LDAIM 192;          8 LPI TOTAL TIME HIGH VALUE
878+    0154 A9C0                                   DB    0A9H,(192);
879     0156                    BITZ  LPI8;         8 LPI?
879+    0156 242E                                   DB    24H,(LPI8);
880     0158                    BMI.  $+4;          YES, GO AROUND
880+    0158 3002                                   DB    3CH,($+4)-$-2;
881     015A                    LDAIM 144;          6 LPI TOTAL TIME HIGH VALUE
881+    015A A990                                   DB    0A9H,(144);
882     015C                    STAZ  TOTIM;        SET TOTAL TIME TO HIGH VALUE
882+    015C 8508                                   DB    85H,(TOTIM);
883     015E                    LDAIM 48;
883+    015E A930                                   DB    0A9H,(48);
884     0160                    STAZ  TIME1;        SET TIME CNTS TO HIGH VALUE
884+    0160 8503                                   DB    85H,(TIME1);
885     0162                    STAZ  TIME2;
885+    0162 8504                                   DB    85H,(TIME2);
886     0164                    STAZ  TIME3;
886+    0164 8505                                   DB    85H,(TIME3);
887     0166                    STAZ  TIME4;
887+    0166 8506                                   DB    85H,(TIME4);
888     0168                    RTS;                RETURN FROM SUBROUTINE
888+    0168 60                                     DB    6CH;
889                     ;
890                     ;  ***  SUBROUTINE TO SWITCH SOLENOIDS
891                     ;
892     0169            SWSOL:  LDAM  PAD;          GET OUTPUT REG
892+    0169 AD                                     DB    0ADH;
892+    016A 0017                                   DW    (PAD);
893     016C                    EORIM 3;            CHANGE BITS 0 AND 1 ONLY
893+    016C 4903                                   DB    49H,(3);
894     016E                    STAM  PAD;          SWITCH SOLENOIDS ON
894+    016E 8D                                     DB    8DH;
894+    016F 0017                                   DW    (PAD);
895     0171                    RTS;                RETURN FROM SUBROUTINE
895+    0171 60                                     DB    6CH;
896                     ;EJECT
897     0200                    ORG   0200H;
```

```
898                                  ;
899                                  ;  ***   INITIAL LOAD OF FORM -->STARTS WHEN LINE PULSES ARE DETECTED
900                                  ;        FROM PRINTER.
901                                  ;
902      0200                        INTLP:   LDAM  MORA;          IS PHOTO CELL COVERED?
902+     0200 AD                                       DB    0ADH;
902+     0201 0116                                     DW    (MORA);
903      0203                                 BPL   TLPA;          YES, GO AROUND
903+     0203 1001                                     DB    1CH,(TLPA)-$-2;
904      0205                                 RTI;                 NO, GO LOOK FOR ANOTHER LINE PULSE
904+     0205 40                                       DB    4CH;
905      0206                        TLPA:    ASLZ  SWB;           SET SW B
905+     0206 0621                                     DB    06H,(SWB);
906      0208                                 LDAM  MORA;          GET LENGTH SWITCHES
906+     0208 AD                                       DB    0ADH;
906+     0209 0116                                     DW    (MORA);
907      020B                                 ANDIM 1FH;           MASK OUT UPPER THREE
907+     020B 291F                                     DB    29H,(1FH);
908      020D                                 EORIM 1FH;           COMPLEMENT THE CNT
908+     020D 491F                                     DB    49H,(1FH);
909      020F                                 CMPIM 12H;           IS LENGTH > 15 INCHES?
909+     020F C912                                     DB    0C9H,(12H);
910      0211                                 BCS   TLPAB;         YES, GO AROUND
910+     0211 B003                                     DB    0B0H,(TLPAB)-$-2;
911      0213                                 JMPM  $+4;           NO, JUMP OVER
911+     0213 4C                                       DB    4CH;
911+     0214 1802                                     DW    ($+4);
912      0216                        TLPAB:   LDAIM 12H;           DEFAULT TO MAX. LENGTH OF 15 INCHES
912+     0216 A912                                     DB    0A9H,(12H);
913      0218                                 STAZ  LENSW;         SAVE IT
913+     0218 8501                                     DB    85H,(LENSW);
914      021A                                 LDAM  PAD;           GET 8 LPI SIGNAL
914+     021A AD                                       DB    0ADH;
914+     021B 0017                                     DW    (PAD);
915      021D                                 BPL   TLPB;          NOT 8 LPI, GO AROUND
915+     021D 101B                                     DB    1CH,(TLPB)-$-2;
916      021F                                 LDAIM 128;
916+     021F A980                                     DB    0A9H,(128);
917      0221                                 STAZ  LPI8;          SET 8 LPI FLAG
917+     0221 852E                                     DB    85H,(LPI8);
918      0223                                 LDAIM 4;             STORE CNT VALUES FOR 8 LPI
918+     0223 A904                                     DB    0A9H,(4);
919      0225                                 STAZ  INCR1;
919+     0225 8509                                     DB    85H,(INCR1);
920      0227                                 LDAIM 2;
920+     0227 A902                                     DB    0A9H,(2);
921      0229                                 STAZ  INCR2;
921+     0229 850A                                     DB    85H,(INCR2);
922      022B                                 LDAIM 8;
922+     022B A908                                     DB    0A9H,(8);
923      022D                                 STAZ  INCH;
923+     022D 850C                                     DB    85H,(INCH);
924      022F                                 LDAIM 44;
924+     022F A92C                                     DB    0A9H,(44);
```

```
925      0231
925+     0231 850B
926      0233
926+     0233 A917
927
928
929
930
931
932      0235
932+     0235 850E
933      0237
933+     0237 4C
933+     0239 5202
934      023A
934+     023A A940
935      023C
935+     023C 852F
936      023E
936+     023E A903
937      0240
937+     0240 8509
938      0242
938+     0242 A901
939      0244
939+     0244 850A
940      0246
940+     0246 A906
941      0248
941+     0248 850C
942      024A
942+     024A A921
943      024C
943+     024C 850B
944      024E
944+     024E A911
945
946
947
948
949
950      0250
950+     0250 850E
951      0252
951+     0252 18
952      0253
952+     0253 A50B
953      0255
953+     0255 6509
954      0257
954+     0257 850B
955      0259
955+     0259 A50E
956      025B
```

```
         STAZ  TLEN;
                                        DB     85H,(TLEN);
         LDAIM 23;
                                        DB     0A9H,(23);
;
;  ***   ADD 4 TO THE ABOVE IMMEDIATE VALUE FOR EACH ONE-HALF INCH THE
;        LEADING EDGE PHOTOCELL IS RAISED ABOVE THE CENTER POINT OF THE
;        CURVED SURFACES.
;
         STAZ  STRT1;
                                        DB     85H,(STRT1);
         JMPM  TLPC;
                                        DB     4CH;
                                        DW     (TLPC);
TLPB:    LDAIM 64;
                                        DB     0A9H,(64);
         STAZ  LPI8;                RESET 8 LPI FLAG
                                        DB     85H,(LPI8);
         LDAIM 3;                   STORE CNT VALUES FOR 6 LPI
                                        DB     0A9H,(3);
         STAZ  INCR1;
                                        DB     85H,(INCR1);
         LDAIM 1;
                                        DB     0A9H,(1);
         STAZ  INCR2;
                                        DB     85H,(INCR2);
         LDAIM 6;
                                        DB     0A9H,(6);
         STAZ  INCH;
                                        DB     85H,(INCH);
         LDAIM 33;
                                        DB     0A9H,(33);
         STAZ  TLEN;
                                        DB     85H,(TLEN);
         LDAIM 17;
                                        DB     0A9H,(17);
;
;  ***   ADD 3 TO THE ABOVE IMMEDIATE VALUE FOR EACH ONE-HALF INCH THE
;        LEADING EDGE PHOTOCELL IS RAISED ABOVE THE CENTER POINT OF THE
;        CURVED SURFACES.
;
         STAZ  STRT1;
                                        DB     85H,(STRT1);
TLPC:    CLC;                       CLEAR CARRY
                                        DB     18H;
TLPD:    LDAZ  TLEN;                GET FORM LENGTH
                                        DB     0A5H,(TLEN);
         ADCZ  INCR1;               ADD 1/2 INCH VALUE
                                        DB     65H,(INCR1);
         STAZ  TLEN;                SAVE IT
                                        DB     85H,(TLEN);
         LDAZ  STRT1;               GET START CNT
                                        DB     0A5H,(STRT1);
         ADCZ  INCR2;               ADD 1/4 INCH VALUE
```

```
956+    025B 650A                          DB     65H,(INCR2);
957     025D                   STAZ  STRT1;   SAVE IT
957+    025D 850F                          DB     85H,(STRT1);
958     025F                   BITZ  LPI8;    IS IT 8 LPI?
958+    025F 242F                          DB     24H,(LPI8);
959     0261                   BMI   TLPE;    YES, GO AROUND
959+    0261 3C11                          DB     3CH,(TLPE)-$-2;
960     0263                   BITZ  SWC;     6 LPI - MAKE ADJUSTMENT IN INC VALUE
960+    0263 2427                          DB     24H,(SWC);
961     0265                   BMI   TLPF;    SW C SET, GO AROUND
961+    0265 3C05                          DB     3CH,(TLPF)-$-2;
962     0267                   ASLZ  SWC;     SET SW C
962+    0267 0622                          DB     06H,(SWC);
963     0269                   JMPM  TLPE;    GO AROUND
963+    0269 4C                            DB     4CH;
963+    026A 7402                          DW     (TLPE);
964     026C          TLPF:    LDAZ  STRT1;   GET START 1
964+    026C A50E                          DB     0A5H,(STRT1);
965     026E                   ADDIM 2;       ADJ. BY 2 EVERY INCH
965+    026E 69C2                          DB     69H,(2);
966     0270                   STAZ  STRT1;   SAVE IT
966+    0270 850E                          DB     85H,(STRT1);
967     0272                   LSRZ  SWC;     RESET SW C
967+    0272 4622                          DB     46H,(SWC);
968     0274          TLPE:    LDAZ  LENSW;   GET LENGTH SWITCH VALUE
968+    0274 A5C1                          DB     0A5H,(LENSW);
969     0276                   CMPIM 0;       = 0?
969+    0276 C900                          DB     0C9H,(0);
970     0278                   BEQ   TLPG;    YES, GO AROUND
970+    0278 F0D5                          DB     0F0H,(TLPG)-$-2;
971     027A                   DECZ  LENSW;   DECR. LENGTH SW
971+    027A C6C1                          DB     0C6H,(LENSW);
972     027C                   JMPM  TLPC;    GO DO MORE
972+    027C 4C                            DB     4CH;
972+    027D 5202                          DW     (TLPC);
973     027F          TLPG:    CLC;           CLEAR CARRY
973+    027F 18                            DB     18H;
974     0280                   LDAZ  TLEN;    GET TOTAL LENGTH
974+    0280 A5CE                          DB     0A5H,(TLEN);
975     0282                   ADDZ  INCH;    ADD 1 INCH CNT
975+    0282 65CC                          DB     65H,(INCH);
976     0284                   STAZ  STRT2;   SAVE IT
976+    0284 850F                          DB     85H,(STRT2);
977     0286                   SEC;           SET CARRY
977+    0286 38                            DB     38H;
978     0287                   LDAZ  STRT1;   GET START 1 CNT
978+    0287 A50E                          DB     0A5H,(STRT1);
979     0289                   SBCZ  INCH;    SUBTRACT 1 INCH
979+    0289 E5CC                          DB     0E5H,(INCH);
980     028B                   CLC;           CLEAR CARRY
980+    028B 18                            DB     18H;
981     028C                   ADDZ  STRT2;   START 3 + START 2
981+    028C 650F                          DB     65H,(STRT2);
982     028E                   STAZ  STRT3;   SAVE IT
```

```
982+    028E 6510                                   DB     85H,(STRT3);
983     0290                  SEC;                SET CARRY
983+    0290 38                                     DB     38H;
984     0291                  LDAZ  TLEN;         GET FORM LENGTH
984+    0291 A50B                                   DB     0A5H,(TLEN);
985     0293                  BITZ  LPI8;         IS IT 8 LPI?
985+    0293 242E                                   DB     24H,(LPI8);
986     0295                  BMI   TLPH;         YES, GO AROUND
986+    0295 3017                                   DB     30H,(TLPH)-$-2;
987                     ;
988                     ;  ***  6 LPI SET UP FOR SPEED SWITCH POINTS
989                     ;
990     0297                  SBCZ  ADJA6;        FORM LENGTH MINUS ADJ VALUES
990+    0297 E511                                   DB     0E5H,(ADJA6);
991     0299                  STAZ  SPA;
991+    0299 851B                                   DB     85H,(SPA);
992     029B                  SBCZ  ADJB6;
992+    029B E512                                   DB     0E5H,(ADJB6);
993     029D                  STAZ  SPB;
993+    029D 851C                                   DB     85H,(SPB);
994     029F                  SBCZ  ADJC6;
994+    029F E513                                   DB     0E5H,(ADJC6);
995     02A1                  STAZ  SPC;
995+    02A1 851D                                   DB     85H,(SPC);
996     02A3                  SBCZ  ADJD6;
996+    02A3 E514                                   DB     0E5H,(ADJD6);
997     02A5                  STAZ  SPD;
997+    02A5 851E                                   DB     85H,(SPD);
998     02A7                  SBCZ  ADJE6;
998+    02A7 E515                                   DB     0E5H,(ADJE6);
999     02A9                  STAZ  SPE;
999+    02A9 851F                                   DB     85H,(SPE);
1000    02AB                  JMPM  TLPJ;
1000+   02AB 4C                                     DB     4CH;
1000+   02AC C202                                   DW     (TLPJ);
1001                    ;
1002                    ;  ***  8 LPI SET UP FOR SPEED SWITCH POINTS
1003                    ;
1004    02AE            TLPH: SBCZ  ADJA8;
1004+   02AE E516                                   DB     0E5H,(ADJA8);
1005    02B0                  STAZ  SPA;
1005+   02B0 851B                                   DB     85H,(SPA);
1006    02B2                  SBCZ  ADJB8;
1006+   02B2 E517                                   DB     0E5H,(ADJB8);
1007    02B4                  STAZ  SPB;
1007+   02B4 851C                                   DB     85H,(SPB);
1008    02B6                  SBCZ  ADJC8;
1008+   02B6 E518                                   DB     0E5H,(ADJC8);
1009    02B8                  STAZ  SPC;
1009+   02B8 851D                                   DB     85H,(SPC);
1010    02BA                  SBCZ  ADJD8;
1010+   02BA E519                                   DB     0E5H,(ADJD8);
1011    02BC                  STAZ  SPD;
1011+   02BC 851E                                   DB     85H,(SPD);
```

```
1012      02BE                          SECZ  ADJE8;
1012+     02BE E51A                                     DB    0E5H,(ADJE8);
1013      02C0                          STAZ  SPE;
1013+     02C0 851F                                     DB    85H,(SPE);
1014      02C2                    TLPJ: LDAIM 1;
1014+     02C2 A901                                     DB    0A9H,(1);
1015      02C4                          STAZ  LPC;                CLEAR LINE PULSE CNT TO 1
1015+     02C4 8500                                     DB    85H,(LPC);
1016      02C6                          RTI;                      GO WAIT FOR INT
1016+     02C6 40                                       DB    4CH;
1017                              ;
1018                              ;  ***  INITIAL LOAD FIRST TWO FORMS,
1019                              ;       ENTER HERE THRU SW B AFTER 2ND LINE PULSE
1020                              ;
1021      02C7                    LOAD2: BITZ  SWE;               SW E SET? *
1021+     02C7 2424                                     DB    24H,(SWE);
1022      02C9                          BMI   D3;                 YES, GO AROUND
1022+     02C9 3016                                     DB    3CH,(D3)-$-2;
1023      02CB                          LDAIM 2CH;                BIT 5 TEST MASK
1023+     02CB A92C                                     DB    0A9H,(2CH);
1024      02CD                          ANDM  MORA;               OUT-FOLD SWITCH SET?
1024+     02CD 2D                                       DB    2DH;
1024+     02CE C116                                     DW    (MORA);
1025      02D0                          BNE   D7;                 NC, GO AROUND
1025+     02D0 D005                                     DB    0D0H,(D7)-$-2;
1026      02D2                          LDAIM 1;                  YES, SET UP TO TURN ON BACK SOLENOID
1026+     02D2 A901                                     DB    0A9H,(1);
1027      02D4                          JMPM  $+4;                GO AROUND
1027+     02D4 4C                                       DB    4CH;
1027+     02D5 D902                                     DW    ($+4);
1028      02D7                    D7:   LDAIM 2;                  SET UP TO TURN ON FRONT SOLENOID
1028+     02D7 A902                                     DB    0A9H,(2);
1029      02D9                          CRAM  PAD;                GET OUTPUT REGISTER
1029+     02D9 0D                                       DB    0DH;
1029+     02DA 0017                                     DW    (PAD);
1030      02DC                          STAM  PAD;                TURN ON CORRECT SOLENOID
1030+     02DC 8D                                       DB    8DH;
1030+     02DD 0017                                     DW    (PAD);
1031      02DF                          ASLZ  SWE;                SET SW E
1031+     02DF 0624                                     DB    06H,(SWE);
1032      02E1                    D3:   INCZ  LPC;                INCREMENT LINE PULSE CNT
1032+     02E1 E600                                     DB    0E6H,(LPC);
1033      02E3                          LDAZ  LPC;                GET LINE PULSE CNT
1033+     02E3 A500                                     DB    0A5H,(LPC);
1034      02E5                          CMPZ  STRT1;              LPC < START 1 CNT?
1034+     02E5 C50E                                     DB    0C5H,(STRT1);
1035      02E7                          BCC   D4;                 YES, GO AROUND
1035+     02E7 9002                                     DB    9CH,(D4)-$-2;
1036      02E9                          BCS   D5;                 LPC = OR > START 1 CNT
1036+     02E9 B001                                     DB    0B0H,(D5)-$-2;
1037      02EB                    D4:   RTI;                      GO WAIT FOR INT
1037+     02EB 40                                       DB    4CH;
1038      02EC                    D5:   LDAM  PAD;                GET OUTPUT REG
1038+     02EC AD                                       DB    0ADH;
```

```
1038+    02ED 0017
1039     02EF
1039+    02EF 2910
1040     02F1
1040+    02F1 8D
1040+    02F2 0017
1041     02F4
1041+    02F4 A500
1042     02F6
1042+    02F6 C50F
1043     02F8
1043+    02F8 90F1
1044     02FA
1044+    02FA A920
1045     02FC
1045+    02FC 2D
1045+    02FD 0116
1046     02FF
1046+    02FF 0005
1047     0301
1047+    0301 A902
1048     0303
1048+    0303 4C
1048+    0304 0803
1049     0306
1049+    0306 A901
1050     0308
1050+    0308 0D
1050+    0309 0017
1051     030B
1051+    030B 8D
1051+    030C 0017
1052     030E
1052+    030E A500
1053     0310
1053+    0310 C510
1054     0312
1054+    0312 90D7
1055     0314
1055+    0314 0623
1056     0316
1056+    0316 0625
1057     0318
1057+    0318 0627
1058     031A
1058+    031A AD
1058+    031B 0017
1059     031D
1059+    031D 091C
1060     031F
1060+    031F 8D
1060+    0320 0017
1061     0322
1061+    0322 A97F
```

```
         ANDIM 1CH;        DW     (PAD);
                           SAVE BIT 4 ONLY - FORMS LOADED INDICATOR
                           DB     29H,(1DH);
         STAM  PAD;        TURN OFF CORRECT SOLENOID
                           DB     8CH;
                           DW     (PAD);
         LDAZ  LPC;        GET LINE PULSE CNT
                           DB     0A5H,(LPC);
         CMPZ  STRT2;      LPC < START 2 CNT
                           DB     0C5H,(STRT2);
         BCC   D4;         YES, GO AROUND
                           DB     9CH,(D4)-$-2;
         LDAIM 2CH;        BIT 5 TEST MASK
                           DB     0A9H,(2DH);
         AND   MORA;       OUT-FOLD SWITCH SET?
                           DB     2DH;
                           DW     (MORA);
         BNE   D6;         NO, GO AROUND
                           DB     0D0H,(D6)-$-2;
         LDAIM 2;          YES, SET UP TO TURN ON FRONT SOLENOID
                           DB     0A9H,(2);
         JMPM  $+4;        GO AROUND
                           DB     4CH;
                           DW     ($+4);
D6:      LDAIM 1;          SET UP TO TURN ON BACK SOLENOID
                           DB     0A9H,(1);
         ORAM  PAD;        GET OUTPUT REGISTER
                           DB     0DH;
                           DW     (PAD);
         STAM  PAD;        TURN ON CORRECT SOLENOID
                           DB     8DH;
                           DW     (PAD);
         LDAZ  LPC;        GET LINE PULSE CNT
                           DB     0A5H,(LPC);
         CMPZ  STRT3;      LPC < START 3 CNT
                           DB     0C5H,(STRT3);
         BCC   D4;         YES, GO AROUND
                           DB     9CH,(D4)-$-2;
         ASLZ  SWD;        SET SW D
                           DB     06H,(SWD);
         ASLZ  EI;         SET EXPECT TIMER INT FLAG
                           DB     06H,(EI);
         ASLZ  EOF;        SET END OF FORM FLAG
                           DB     06H,(EOF);
         LDAM  PAD;        GET OUTPUT REGISTER
                           DB     0ADH;
                           DW     (PAD);
         ORAIM 1DH;        OR IN 'FORMS LOADED' BIT
                           DB     09H,(1DH);
         STAM  PAD;        SET 'FORMS LOADED' INDICATOR
                           DB     8DH;
                           DW     (PAD);
         LDAIM 127;        LOAD CNT = 127
                           DB     0A9H,(127);
```

```
1062      0324                          STAM  ITX24;          LOAD TIMER: 127 X 1,024 - ENABLE INT
1062+     0324 8D                                                   DB    8CH;
1062+     0325 0F17                                                 DW    (ITX24);
1063      0327                          LCAIM 0;
1063+     0327 A900                                                 DB    0A9H,(0);
1064      0329                          STAZ  LPC;            CLEAR LINE PULSE CNT
1064+     0329 8500                                                 DB    85H,(LPC);
1065      032B                          JSRM  SWSOL;          GO SUB SWITCH SOLENOIDS
1065+     032B 20                                                   DB    2CH;
1065+     032C 6901                                                 DW    (SWSOL);
1066      032E                          RTI;                  GO WAIT FOR INT
1066+     032E 4C                                                   DB    4CH;
1067                                ;
1068                                ;  ***  FAST LINE PULSE CONTROL.  ENTER HERE THRU SW D AFTER
1069                                ;       FIRST TWO FORMS ARE LOADED.
1070                                ;
1071      032F                      FLP:  BITZ  TF;             TIMER FLAG SET?
1071+     032F 2426                                                 DB    24H,(TF);
1072      0331                          BMI   FLPA;           YES, GO AROUND
1072+     0331 3010                                                 DB    3CH,(FLPA)-$-2;
1073      0333                          LDAM  TX64;           READ TIMER, DISABLE IRQ
1073+     0333 AD                                                   DB    0ADH;
1073+     0334 0617                                                 DW    (TX64);
1074      0336                          STAZ  NEWTI;          SAVE CNT
1074+     0336 8507                                                 DB    85H,(NEWTI);
1075      0338                          LDAIM 127;            LOAD CNT = 127
1075+     0338 A97F                                                 DB    0A9H,(127);
1076      033A                          STAM  ITX24;          LOAD TIMER: 127 X 1,024 - ENABLE INT
1076+     033A 8D                                                   DB    8CH;
1076+     033B 0F17                                                 DW    (ITX24);
1077      033D                          JSRM  SPDCK;          GO SUB SPEED CHECK
1077+     033D 20                                                   DB    2CH;
1077+     033E A903                                                 DW    (SPDCK);
1078      0340                          JMPM  FLPC;           GO AROUND
1078+     0340 4C                                                   DB    4CH;
1078+     0341 4D03                                                 DW    (FLPC);
1079                                ;
1080                                ;  ***  TIMER ALREADY TIMED OUT, ADJUST
1081                                ;
1082      0343                      FLPA: LSRZ  TF;             RESET TIMER FLAG
1082+     0343 4626                                                 DB    46H,(TF);
1083      0345                          LDAM  TX64;           READ TIMER, DISABLE IRQ
1083+     0345 AD                                                   DB    0ADH;
1083+     0346 0617                                                 DW    (TX64);
1084      0348                          LDAIM 127;            LOAD CNT = 127
1084+     0348 A97F                                                 DB    0A9H,(127);
1085      034A                          STAM  ITX24;          LOAD TIMER: 127 X 1,024 - ENABLE INT
1085+     034A 8D                                                   DB    8CH;
1085+     034B 0F17                                                 DW    (ITX24);
1086      034D                      FLPC: LDAIM 128;
1086+     034D A980                                                 DB    0A9H,(128);
1087      034F                          STAZ  EI;             SET EXPECT TIMER INT. FLAG
1087+     034F 8525                                                 DB    85H,(EI);
1088      0351                          INCZ  LPC;            INCR. LINE PULSE CNT
```

```
1088+   0351 E600
1089    0353
1089+   0353 A500
1090    0355
1090+   0355 C51F
1091    0357
1091+   0357 9002
1092    0359
1092+   0359 B001
1093    035B
1093+   035B 40
1094    035C
1094+   035C A940
1095    035E
1095+   035E 8527
1096    0360
1096+   0360 2429
1097    0362
1097+   0362 3039
1098    0364
1098+   0364 A500
1099    0366
1099+   0366 C51E
1100    0368
1100+   0368 90F1
1101    036A
1101+   036A 242A
1102    036C
1102+   036C 302F
1103    036E
1103+   036E C51D
1104    0370
1104+   0370 90E9
1105    0372
1105+   0372 242B
1106    0374
1106+   0374 3027
1107    0376
1107+   0376 C51C
1108    0378
1108+   0378 90E1
1109    037A
1109+   037A 242C
1110    037C
1110+   037C 301F
1111    037E
1111+   037E C51B
1112    0380
1112+   0380 90D9
1113    0382
1113+   0382 242D
1114    0384
1114+   0384 3017
1115    0386
```

```
                DB      0E6H,(LPC);
        LDAZ    LPC;            GET LINE PULSE CNT
                DB      0A5H,(LPC);
        CMPZ    SPE;            < SWITCH POINT E?
                DB      0C5H,(SPE);
        BCC     F1;             YES, GO AROUND
                DB      9CH,(F1)-$-2;
        BCS     F2;             LPC = OR > SPE
                DB      0B0H,(F2)-$-2;
F1:     RTI;                    GO WAIT FOR INT
                DB      4CH;
F2:     LDAIM 64;
                DB      0A9H,(64);
        STAZ    EOF;            RESET END OF FORM FLAG
                DB      85H,(EOF);
        BITZ    SWFE;           SWITCH FLAG 'E' SET?
                DB      24H,(SWFE);
        BMI     FLPD;           YES, GO AROUND
                DB      3CH,(FLPD)-$-2;
        LDAZ    LPC;            GET LINE PULSE CNT
                DB      0A5H,(LPC);
        CMPZ    SPD;            LPC < SWITCH POINT D?
                DB      0C5H,(SPD);
        BCC     F1;             YES, GO AROUND
                DB      9CH,(F1)-$-2;
        BITZ    SWFD;           SW FLAG D SET?
                DB      24H,(SWFD);
        BMI     FLPD;           YES, GO AROUND
                DB      3CH,(FLPD)-$-2;
        CMPZ    SPC;            LPC < SWITCH POINT C?
                DB      0C5H,(SPC);
        BCC     F1;             YES, GO AROUND
                DB      9CH,(F1)-$-2;
        BITZ    SWFC;           SW FLAG C SET?
                DB      24H,(SWFC);
        BMI     FLPD;           YES, GO AROUND
                DB      3CH,(FLPD)-$-2;
        CMPZ    SPB;            LPC < SWITCH POINT B?
                DB      0C5H,(SPB);
        BCC     F1;             YES, GO AROUND
                DB      9CH,(F1)-$-2;
        BITZ    SWFB;           SW FLAG B SET?
                DB      24H,(SWFB);
        BMI     FLPD;           YES, GO AROUND
                DB      3CH,(FLPD)-$-2;
        CMPZ    SPA;            LPC < SWITCH POINT A?
                DB      0C5H,(SPA);
        BCC     F1;             YES, GO AROUND
                DB      9CH,(F1)-$-2;
        BITZ    SWFA;           SW FLAG A SET?
                DB      24H,(SWFA);
        BMI     FLPD;           YES, GO AROUND
                DB      3CH,(FLPD)-$-2;
EOFF:   LDAZ    LPC;            GET LINE PULSE CNT
```

```
1115+   0386 A500                                          DB    0A5H,(LPC);
1116    0388                        CMPZ  TLEN;           LPC < FORM LENGHT?
1116+   0388 C50B                                          DB    0C5H,(TLEN);
1117    038A                        BCC   F1;             YES, GO AROUND
1117+   038A 90CF                                          DB    9CH,(F1)-$-2;
1118    038C                        ASLZ  EOF;            SET END OF FORM FLAG
1118+   038C 0627                                          DB    06H,(EOF);
1119    038E                        LDAIM 0;
1119+   038E A900                                          DB    0A9H,(0);
1120    0390                        STAZ  LPC;            CLEAR LINE PULSE CNT
1120+   0390 8500                                          DB    85H,(LPC);
1121    0392                        BITZ  SOLSF;          SOLENOID SWITCH FLAG SET?
1121+   0392 2428                                          DB    24H,(SOLSF);
1122    0394                        BMI   EOF2;           YES, GO AROUND
1122+   0394 3004                                          DB    3CH,(EOF2)-$-2;
1123    0396                        JSRM  SWSOL;          GO SUB SWITCH SOLENOIDS
1123+   0396 20                                            DB    2CH;
1123+   0397 6901                                          DW    (SWSOL);
1124    0399                        RTI;                  GO WAIT FOR INT.
1124+   0399 40                                            DB    4CH;
1125    039A                EOF2:   LSRZ  SOLSF;          RESET SOLENOID SWITCHED FLAG
1125+   039A 4628                                          DB    46H,(SOLSF);
1126    039C                        RTI;                  GO WAIT FOR INT
1126+   039C 40                                            DB    4CH;
1127                        ;
1128                        ;  ***  SWITCH SOLENOIDS IF SWITCH POINT CNT HAS BEEN REACHED
1129                        ;       AND APPROPRIATE SWITCH FLAG HAS BEEN SET
1130                        ;
1131    039D                FLPD:   BITZ  SOLSF;          SOLENOID SWITCH FLAG SET?
1131+   039D 2428                                          DB    24H,(SOLSF);
1132    039F                        BMI   FLPE;           YES, ALREADY SWITCHED, WAIT FOR INT
1132+   039F 3005                                          DB    3CH,(FLPE)-$-2;
1133    03A1                        ASLZ  SOLSF;          SET SOLENIOD SWITCHED FLAG
1133+   03A1 0628                                          DB    06H,(SOLSF);
1134    03A3                        JSRM  SWSOL;          GO SUB SWITCH SOLENOIDS
1134+   03A3 20                                            DB    2CH;
1134+   03A4 6901                                          DW    (SWSOL);
1135    03A6                FLPE:   JMPM  EOFP;           GO CHECK FOR END OF FORM
1135+   03A6 4C                                            DB    4CH;
1135+   03A7 8603                                          DW*   (EOFP);
1136                        ;
1137                        ;  ***  SUBROUTINE TO CALCULATE SPEED AND SET APPROPRIATE SPEED
1138                        ;       SWITCH FLAGS.  TOTAL TIME IS PRESET TO A COUNT OF 192
1139                        ;       FOR 8 LPI & 144 FOR 6 LPI.  INDIVIDUAL TIMES ARE PRESET TO
1140                        ;       A COUNT OF 48 WHICH IS THE TIME FOR ONE LINE AT A PRINTING
1141                        ;       SPEED OF 1250 LPM.
1142                        ;
1143    03A9                SPDCK:  LDAZ  NEWTI;          GET STORED TIME VALUE
1143+   03A9 A507                                          DB    0A5H,(NEWTI);
1144    03AB                        BMI   SPDA;           IT'S NEGATIVE, GO AROUND
1144+   03AB 3010                                          DB    3CH,(SPDA)-$-2;
1145    03AD                        BEQ   SPDA;           IT'S ZERO, GO AROUND
1145+   03AD F00E                                          DB    0F0H,(SPDA)-$-2;
1146    03AF                        SEC;                  SET CARRY
```

```
1146+   03AF 38                          DB     38H;
1147    03B0                     LDAIM 127;      GET TIME CONSTANT
1147+   03B0 A97F                        DB     0A9H,(127);
1148    03B2                     SBCZ  NEWTI;    SUBTRACT NEW TIME
1148+   03B2 E507                        DB     0E5H,(NEWTI);
1149    03B4                     STAZ  NEWTI;    SAVE NEW TIME
1149+   03B4 8507                        DB     85H,(NEWTI);
1150    03B6                     CMPIM 48;       NEWTIME > 48?
1150+   03B6 C930                        DB     0C9H,(48);
1151    03B8                     BCS   SPDA;     YES, GO AROUND
1151+   03B8 B003                        DB     0B0H,(SPDA)-$-2;
1152    03BA                     JMPM  SPDB;     NEWTIME < 48
1152+   03BA 4C                          DB     4CH;
1152+   03BB C103                        DW     (SPDB);
1153    03BD                     SPDA:  LDAIM 48;  SET CNT TO 48 = 1 LINE AT 125C LPM
1153+   03BD A930                        DB     0A9H,(48);
1154    03BF                     STAZ  NEWTI;    USE AS TIME VALUE
1154+   03BF 8507                        DB     85H,(NEWTI);
1155    03C1                     SPDB:  LDAZ  TIME1;  GET TIME 1
1155+   03C1 A503                        DB     0A5H,(TIME1);
1156    03C3                     STAZ  OLDTI;    STORE IN OLD TIME
1156+   03C3 8502                        DB     85H,(OLDTI);
1157    03C5                     LDAZ  TIME2;    GET TIME 2
1157+   03C5 A504                        DB     0A5H,(TIME2);
1158    03C7                     STAZ  TIME1;    SHIFT IT DOWN
1158+   03C7 8503                        DB     85H,(TIME1);
1159    03C9                     LDAZ  TIME3;    GET TIME 3
1159+   03C9 A505                        DB     0A5H,(TIME3);
1160    03CB                     STAZ  TIME2;    SHIFT IT DOWN
1160+   03CB 8504                        DB     85H,(TIME2);
1161    03CD                     BITZ  LPI8;     IS IT 8 LPI?
1161+   03CD 242E                        DB     24H,(LPI8);
1162    03CF                     BMI   SPDC;     YES, GO AROUND
1162+   03CF 3007                        DB     3CH,(SPDC)-$-2;
1163    03D1                     LDAZ  NEWTI;    6 LPI, USE 3 VALUES , GET NEW TIME
1163+   03D1 A507                        DB     0A5H,(NEWTI);
1164    03D3                     STAZ  TIME3;    SHIFT INTO LATEST TIME POSITION
1164+   03D3 8505                        DB     85H,(TIME3);
1165    03D5                     JMPM  SPDC;     GO AROUND
1165+   03D5 4C                          DB     4CH;
1165+   03D6 E003                        DW     (SPDC);
1166    03D8                     SPDC:  LDAZ  TIME4;  GET TIME 4
1166+   03D8 A506                        DB     0A5H,(TIME4);
1167    03DA                     STAZ  TIME3;    SHIFT IT DOWN
1167+   03DA 8505                        DB     85H,(TIME3);
1168    03DC                     LDAZ  NEWTI;    GET NEW TIME
1168+   03DC A507                        DB     0A5H,(NEWTI);
1169    03DE                     STAZ  TIME4;    SHIFT INTO LATEST TIME POSITION
1169+   03DE 8506                        DB     85H,(TIME4);
1170    03E0                     SPDD:  SEC;     SET CARRY
1170+   03E0 38                          DB     38H;
1171    03E1                     LDAZ  TOTIM;    GET OLD TOTAL TIME
1171+   03E1 A508                        DB     0A5H,(TOTIM);
1172    03E3                     SBCZ  OLDTI;    SUBTRACT OUT 1ST TIME
```

```
1172+     03E3 E502                                                          DB     0E5H,(OLDTI);
1173      03E5                                  CLC;                    CLEAR CARRY
1173+     03E5 18                                                          DB     18H;
1174      03E6                                  ADCZ  NEWTI;            ADD IN NEW TIME
1174+     03E6 6507                                                        DB     65H,(NEWTI);
1175      03E8                                  STAZ  TOTIM;            SAVE IT
1175+     03E8 8508                                                        DB     85H,(TOTIM);
1176      03EA                                  JMPM  SPENT;            GO DO SPEED CHECK
1176+     03EA 4C                                                          DB     4CH;
1176+     03EB 9B00                                                        DW     (SPENT);
1177      0000                                  END;
          ERRORS: NONE        ASSEMBLER USED 6DE9 BYTES     0 CARDS PUNCHED        3 MINUTES 17 SECONDS ELAPSED
```

```
LABEL VALUE LINE  REFERENCES
BXSUM 0029     1
A     0007     1
ACR   16DE   628
ADCIM          23   965
ADCIX          44
ADCIY          47
ADCM           32
ADCMX          36
ADCMY          40
ADCZ           26   953  956  975  981 1174
ADCZX          29
ADJA6 0011   668   990
ADJA8 0016   673  1004
ADJB6 0012   669   992
ADJB8 0017   674  1006
ADJC6 0013   670   994
ADJC8 0018   675  1008
ADJD6 0014   671   996
ADJD8 0019   676  1010
ADJE6 001A   677  1012
ANDIM          53   856  907 1039
ANDIX          74
ANDIY          77
ANDM           62  1024 1045
ANDMX          66
ANDMY          70
ANDZ           56
ANDZX          59
ASLA           83
ASLM           92
ASLMX          96
ASLZ           86   823  824  825  826  827  905  962 1031 1055 1056 1057 1118 1133
ASLZX          89
B     0000      1
BCC          103   800  802  804  806  808  810 1035 1043 1054 1091 1100 1104 1108 1112 1117
BCS          106   765  767  910 1036 1092 1151
```

| | | | | | | | | | | | | | | | | | | | | | | |
|---|---|---|---|---|---|---|---|---|---|---|---|---|---|---|---|---|---|---|---|---|---|---|
| BEQ | | 109 | 970 | 1145 | | | | | | | | | | | | | | | | | | |
| BITM | | 133 | 769 | 851 | | | | | | | | | | | | | | | | | | |
| BITZ | | 130 | 774 | 776 | 816 | 818 | 841 | 861 | 879 | 958 | 960 | 985 | 1021 | 1071 | 1096 | 1101 | 1105 | 1109 | 1113 | 1121 | 1131 | 1161 |
| BMI | | 112 | 775 | 777 | 819 | 862 | 865 | 880 | 959 | 961 | 986 | 1022 | 1072 | 1097 | 1102 | 1106 | 1110 | 1114 | 1122 | 1132 | 1144 | 1162 |
| BNE | | 115 | 754 | 870 | 1025 | 1046 | | | | | | | | | | | | | | | | |
| BPL | | 118 | 763 | 770 | 817 | 842 | 903 | 915 | | | | | | | | | | | | | | |
| BRK | | 140 | | | | | | | | | | | | | | | | | | | | |
| BVC | | 121 | | | | | | | | | | | | | | | | | | | | |
| BVS | | 124 | 852 | | | | | | | | | | | | | | | | | | | |
| C | C001 | 1 | | | | | | | | | | | | | | | | | | | | |
| CLC | | 146 | 951 | 973 | 980 | 1173 | | | | | | | | | | | | | | | | |
| CLD | | 149 | 705 | | | | | | | | | | | | | | | | | | | |
| CLI | | 152 | 756 | | | | | | | | | | | | | | | | | | | |
| CLV | | 155 | | | | | | | | | | | | | | | | | | | | |
| CMPIM | | 161 | 799 | 801 | 803 | 805 | 887 | 809 | 909 | 969 | 1150 | | | | | | | | | | | |
| CMPIX | | 182 | | | | | | | | | | | | | | | | | | | | |
| CMPIY | | 185 | | | | | | | | | | | | | | | | | | | | |
| CMPM | | 170 | | | | | | | | | | | | | | | | | | | | |
| CMPMX | | 174 | | | | | | | | | | | | | | | | | | | | |
| CMPMY | | 178 | | | | | | | | | | | | | | | | | | | | |
| CMPZ | | 164 | 1034 | 1042 | 1053 | 1090 | 1099 | 1103 | 1107 | 1111 | 1116 | | | | | | | | | | | |
| CMPZX | | 167 | | | | | | | | | | | | | | | | | | | | |
| CPXIM | | 188 | | | | | | | | | | | | | | | | | | | | |
| CPXM | | 194 | | | | | | | | | | | | | | | | | | | | |
| CPXZ | | 191 | | | | | | | | | | | | | | | | | | | | |
| CPYIM | | 198 | | | | | | | | | | | | | | | | | | | | |
| CPYM | | 204 | | | | | | | | | | | | | | | | | | | | |
| CPYZ | | 201 | | | | | | | | | | | | | | | | | | | | |
| D | 0002 | 1 | | | | | | | | | | | | | | | | | | | | |
| D3 | 02E1 | 1032 | 1022 | | | | | | | | | | | | | | | | | | | |
| D4 | 02EB | 1037 | 1035 | 1043 | 1054 | | | | | | | | | | | | | | | | | |
| D5 | 02EC | 1038 | 1036 | | | | | | | | | | | | | | | | | | | |
| D6 | 0306 | 1049 | 1046 | | | | | | | | | | | | | | | | | | | |
| D7 | 02D7 | 1028 | 1025 | | | | | | | | | | | | | | | | | | | |
| DECM | | 217 | | | | | | | | | | | | | | | | | | | | |
| DECMX | | 221 | | | | | | | | | | | | | | | | | | | | |
| DECZ | | 211 | 869 | 971 | | | | | | | | | | | | | | | | | | |
| DECZX | | 214 | | | | | | | | | | | | | | | | | | | | |
| DEX | | 225 | 753 | | | | | | | | | | | | | | | | | | | |
| DEY | | 228 | | | | | | | | | | | | | | | | | | | | |
| E | 0003 | 1 | | | | | | | | | | | | | | | | | | | | |
| EI | 0025 | 688 | 841 | 843 | 1056 | 1087 | | | | | | | | | | | | | | | | |
| EOF | 0027 | 690 | 818 | 1057 | 1095 | 1118 | | | | | | | | | | | | | | | | |
| EOF2 | 039A | 1125 | 1122 | | | | | | | | | | | | | | | | | | | |
| EOFP | 0386 | 1115 | 1135 | | | | | | | | | | | | | | | | | | | |
| EORIM | | 234 | 893 | 908 | | | | | | | | | | | | | | | | | | |
| EORIX | | 255 | | | | | | | | | | | | | | | | | | | | |
| EORIY | | 258 | | | | | | | | | | | | | | | | | | | | |
| EORM | | 243 | | | | | | | | | | | | | | | | | | | | |
| EORMX | | 247 | | | | | | | | | | | | | | | | | | | | |
| EORMY | | 251 | | | | | | | | | | | | | | | | | | | | |
| EORZ | | 237 | | | | | | | | | | | | | | | | | | | | |
| EORZX | | 240 | | | | | | | | | | | | | | | | | | | | |
| F1 | 035B | 1093 | 1091 | 1100 | 1104 | 1108 | 1112 | 1117 | | | | | | | | | | | | | | |

| | | | |
|---|---|---|---|
| F2 | 035C | 1094 | 1092 |
| FLP | 032F | 1071 | 779 |
| FLPA | 0343 | 1082 | 1072 |
| FLPC | 034D | 1086 | 1078 |
| FLPD | 039D | 1131 | 1097 1102 1106 1110 1114 |
| FLPE | 03A6 | 1135 | 1132 |
| H | 00C4 | 1 | |
| IER | 160E | 631 | 720 859 |
| IFR | 160D | 630 | 725 726 762 773 782 |
| INCH | 000C | 663 | 923 941 975 979 |
| INCM | | 270 | |
| INCMX | | 274 | |
| INCR1 | 00C9 | 660 | 919 937 953 |
| INCR2 | 000A | 661 | 921 939 956 |
| INCZ | | 264 | 1032 1088 |
| INCZX | | 267 | |
| INTLP | 02C0 | 902 | 778 |
| INXX | | 278 | |
| INYY | | 281 | |
| IRG | 1799 | 615 | 609 611 |
| IRQST | 0061 | 762 | 615 |
| ITX1 | 170C | 642 | |
| ITX24 | 17CF | 645 | 849 1062 1076 1085 |
| ITX64 | 17CE | 644 | |
| ITX8 | 17CD | 643 | |
| IX | 0008 | 1 | |
| IY | 0018 | 1 | |
| JMPI | | 291 | |
| JMPM | | 287 | 613 757 758 771 778 779 780 787 860 863 868 871 874 911 933 963 972 1000 1027 1048 1078 1135 1152 1165 1176 |
| JSRM | | 295 | 755 821 846 847 1065 1077 1123 1134 |
| L | 0005 | 1 | |
| LDAIM | | 302 | 605 607 706 719 727 751 772 781 785 792 844 848 853 858 866 872 878 881 883 912 916 918 920 922 924 926 934 936 938 940 942 944 1014 1023 1026 1028 1044 1047 1049 1061 1063 1075 1084 1086 1094 1119 1147 1153 |
| LDAIX | | 323 | |
| LDAIY | | 326 | |
| LDAM | | 311 | 609 611 725 762 840 855 864 892 902 906 914 1038 1058 1073 1083 |
| LDAMX | | 315 | |
| LDAMY | | 319 | |
| LDAZ | | 305 | 798 952 955 964 968 974 978 984 1033 1041 1052 1089 1098 1115 1143 1155 1157 1159 1163 1166 1168 1171 |
| LDAZX | | 308 | |
| LDXIM | | 329 | 750 783 |
| LDXM | | 338 | |
| LDXMY | | 342 | |
| LDXZ | | 332 | |
| LDXZY | | 335 | |
| LDYIM | | 346 | |
| LDYM | | 355 | |
| LDYMX | | 359 | |
| LDYZ | | 349 | |
| LDYZX | | 352 | |
| LENSW | 0001 | 652 | 913 968 971 |
| LOAD2 | 02C7 | 1021 | 780 |

| | | | |
|---|---|---|---|
| LPC | 0000 | 651 | 1015 1032 1033 1041 1052 1064 1088 1089 1098 1115 1120 |
| LPI8 | 002E | 697 | 879 917 935 958 985 1161 |
| LPIA | 0085 | 779 | 775 |
| LPIB | 0088 | 780 | 777 |
| LPINT | 0075 | 772 | 765 |
| LPRS | 006C | 768 | 770 |
| LSRA | | 366 | |
| LSRM | | 375 | |
| LSRMX | | 379 | |
| LSRZ | | 369 | 820 843 967 1082 1125 |
| LSRZX | | 372 | |
| M | 0006 | 1 | |
| MDDRA | 1603 | 626 | 732 |
| MDDRB | 1602 | 625 | |
| MORA | 1601 | 624 | 851 864 902 906 1024 1045 |
| MORB | 1600 | 623 | |
| NEWTI | 0007 | 658 | 1074 1143 1148 1149 1154 1163 1168 1174 |
| NOOP | | 386 | |
| OLDTI | 0002 | 653 | 1156 1172 |
| ORAIM | | 392 | 1059 |
| ORAIX | | 413 | |
| ORAIY | | 416 | |
| ORAM | | 401 | 1029 1050 |
| ORAMX | | 405 | |
| ORAMY | | 409 | |
| ORAZ | | 395 | |
| ORAZX | | 398 | |
| PAD | 1700 | 633 | 786 855 857 873 892 894 914 1029 1030 1038 1040 1050 1051 1058 1060 |
| PADD | 1701 | 634 | 707 |
| PBD | 1702 | 635 | |
| PBDD | 1703 | 636 | 728 |
| PCR | 160C | 629 | 748 |
| PHA | | 422 | |
| PHP | | 425 | |
| PLA | | 431 | |
| PLP | | 434 | |
| PSW | 0006 | 1 | |
| ROLA | | 440 | |
| ROLM | | 449 | |
| ROLMX | | 453 | |
| ROLZ | | 443 | |
| ROLZX | | 446 | |
| RORA | | 457 | 764 766 |
| RORM | | 466 | |
| RORMX | | 470 | |
| RORZ | | 460 | |
| RORZX | | 463 | |
| RSINT | 008B | 781 | 767 |
| RSINX | 0090 | 783 | 874 |
| RTI | | 477 | 768 850 904 1016 1037 1066 1093 1124 1126 |
| RTS | | 480 | 822 828 888 895 |
| SBCIM | | 486 | |
| SBCIX | | 507 | |
| SBCIY | | 510 | |

| | | | |
|---|---|---|---|
| SBCM | | 495 | |
| SBCMX | | 499 | |
| SBCMY | | 503 | |
| SBCZ | | 489 | 979 990 992 994 996 998 1004 1006 1008 1010 1012 1148 1172 |
| SBCZX | | 492 | |
| SEC | | 516 | 977 983 1146 1170 |
| SED | | 519 | |
| SEI | | 522 | 704 |
| SETLP | 0052 | 752 | 754 |
| SOLSF | 0028 | 691 | 816 820 1121 1125 1131 1133 |
| SP | 0006 | 1 | |
| SPA | 001B | 678 | 991 1005 1111 |
| SPB | 001C | 679 | 993 1007 1107 |
| SPC | 001D | 680 | 995 1009 1103 |
| SPD | 001E | 681 | 997 1011 1099 |
| SPD1 | 00D7 | 827 | 808 |
| SPD2 | 00D5 | 826 | 806 |
| SPD3 | 00D3 | 825 | 804 |
| SPD4 | 00D1 | 824 | 802 |
| SPD5 | 00CF | 823 | 800 |
| SPDA | 038D | 1153 | 1144 1145 1151 |
| SPDB | 03C1 | 1155 | 1152 |
| SPDC | 03D8 | 1166 | 1162 |
| SPDCK | 03A9 | 1143 | 1077 |
| SPDD | 03E0 | 1170 | 1165 |
| SPE | 001F | 682 | 999 1013 1090 |
| SPENT | 009B | 792 | 847 1176 |
| SPOUT | 0009 | 828 | 810 817 819 |
| STAIX | | 546 | |
| STAIY | | 549 | |
| STAM | | 534 | 606 608 610 612 707 720 726 728 732 748 773 782 786 849 857 859 873 894 1030 1040 1051 1060 1062 1076 1085 |
| STAMX | | 538 | |
| STAMY | | 542 | |
| START | 002F | 704 | 613 787 |
| STAZ | | 528 | 749 793 794 795 796 797 845 854 867 882 884 885 886 887 913 917 919 921 923 925 932 935 937 939 941 943 950 954 957 966 976 982 991 993 995 997 999 1005 1007 1009 1011 1013 1015 1064 1074 1087 1095 1120 1149 1154 1156 1158 1160 1164 1167 1169 1175 |
| STAZX | | 531 | 752 |
| STRT1 | 000E | 665 | 932 950 955 957 964 966 978 1034 |
| STRT2 | 000F | 666 | 976 981 1042 |
| STRT3 | 0010 | 667 | 982 1053 |
| STXM | | 558 | |
| STXZ | | 552 | |
| STXZY | | 555 | |
| STYM | | 568 | |
| STYZ | | 562 | |
| STYZX | | 565 | |
| SWB | 0021 | 684 | 776 905 |
| SWC | 0022 | 685 | 960 962 967 |
| SWD | 0023 | 686 | 774 1055 |
| SWE | 0024 | 687 | 1021 1031 |
| SWFA | 002D | 696 | 793 827 1113 |
| SWFB | 002C | 695 | 794 826 1109 |

| | | | | | | | | | |
|---|---|---|---|---|---|---|---|---|---|
| SWFC | 002B | 694 | 795 | 825 | 1105 | | | | |
| SWFD | 002A | 693 | 796 | 824 | 1101 | | | | |
| SWFE | 0029 | 692 | 797 | 823 | 1096 | | | | |
| SWSOL | 0169 | 892 | 821 | 1065 | 1123 | 1134 | | | |
| TAX | | 575 | | | | | | | |
| TAY | | 578 | | | | | | | |
| TF | 0026 | 689 | 845 | 1071 | 1082 | | | | |
| TICK | 006D | 769 | 763 | | | | | | |
| TIFIL | 0154 | 878 | 755 | 846 | | | | | |
| TIME1 | 0003 | 654 | 884 | 1155 | 1158 | | | | |
| TIME2 | 0004 | 655 | 885 | 1157 | 1160 | | | | |
| TIME3 | 0005 | 656 | 886 | 1159 | 1164 | 1167 | | | |
| TIME4 | 0006 | 657 | 887 | 1166 | 1169 | | | | |
| TINA | 0119 | 851 | 842 | | | | | | |
| TINB | 0113 | 848 | 860 | 863 | 868 | 871 | | | |
| TIND | 0132 | 861 | 852 | | | | | | |
| TINE | 0145 | 869 | 865 | | | | | | |
| TINT | 0100 | 840 | 771 | | | | | | |
| TLEN | 000B | 662 | 925 | 943 | 952 | 954 | 974 | 984 | 1116 |
| TLPA | 0206 | 905 | 903 | | | | | | |
| TLPAB | 0216 | 912 | 910 | | | | | | |
| TLPB | 023A | 934 | 915 | | | | | | |
| TLPC | 0252 | 951 | 933 | 972 | | | | | |
| TLPD | 0253 | 952 | | | | | | | |
| TLPE | 0274 | 968 | 959 | 963 | | | | | |
| TLPF | 026C | 964 | 961 | | | | | | |
| TLPG | 027F | 973 | 970 | | | | | | |
| TLPH | 02AE | 1004 | 986 | | | | | | |
| TLPJ | 02C2 | 1014 | 1000 | | | | | | |
| TOTIM | 0008 | 659 | 798 | 882 | 1171 | 1175 | | | |
| TSX | | 584 | | | | | | | |
| TX024 | 1707 | 640 | 769 | | | | | | |
| TX1 | 1704 | 637 | | | | | | | |
| TX64 | 1706 | 639 | 840 | 1073 | 1083 | | | | |
| TX8 | 1705 | 638 | | | | | | | |
| TXA | | 587 | | | | | | | |
| TXS | | 590 | 784 | | | | | | |
| TYA | | 581 | | | | | | | |
| ULCNT | 000D | 664 | 749 | 867 | 869 | | | | |
| ULSW | 0020 | 683 | 752 | 854 | 861 | | | | |
| WAIT | 005B | 757 | | | | | | | |

Having thus described the invention, what is claimed is:

1. A paper stacker for the refolding of a continuous unfolded paper form comprising:

a first and a second forced air supply;

a first and a second curved surface closely positioned one to another in a facing relationship;

paper form receiving means positioned to receive and stack the continuous paper form in an original configuration; said receiving means having first and second adjustable side means for accommodating various size refolded forms;

first and second extendable supply means for supplying sheets having an adjustable length, said sheets covering said first and second curved surfaces, respectively, and attached to said first and second side means, respectively, said sheets having lengths adjustable in response to adjustment of said side means; and means for controlling forced air, said means having an input and output, said input of said forced air control means coupled to movement of said paper form to receive location and speed information therefrom, said output of said forced air control means coupled to said first and second forced air supply, such that the location and speed information received by said forced air control means causes said forced air supply to alternately operate to attach to said curved surfaces and said sheets for urging said continuous form over said first and second curved surfaces and along said sheets toward said side means in an alternating manner whereby said unfolded form is forced to refold in the original configuration.

2. The paper stacker as set forth in claim 1 further including a paper guide means positioned in the paper path ahead of said first and second curved surfaces such that said continuous paper form is guided between said curved surfaces.

3. The paper stacker as set forth in claim 1 further including a paper sensing means connected to said control means to indicate thereto the presence or absence of said continuous paper form.

4. The paper stacker as set forth in claim 1, wherein said control means includes a microprocessor.

5. The paper stacker of claim 2 wherein said paper guide means comprises a pair of diverging guide members.

* * * * *